US009864397B2

(12) United States Patent
Okamura et al.

(10) Patent No.: US 9,864,397 B2
(45) Date of Patent: Jan. 9, 2018

(54) MULTI-DIRECTIONAL INPUT DEVICE

(71) Applicants: NINTENDO CO., LTD., Kyoto-shi, Kyoto (JP); HOSIDEN CORPORATION, Osaka (JP)

(72) Inventors: Takanori Okamura, Kyoto (JP); Junji Takamoto, Kyoto (JP); Mitsuhiro Asano, Osaka (JP)

(73) Assignees: NINTENDO CO., LTD., Kyoto (JP); HOSIDEN CORPORATION, Osaka (JP)

( * ) Notice: Subject to any disclaimer, the term of this patent is extended or adjusted under 35 U.S.C. 154(b) by 88 days.

(21) Appl. No.: 15/131,357

(22) Filed: Apr. 18, 2016

(65) Prior Publication Data

US 2016/0313759 A1 Oct. 27, 2016

(30) Foreign Application Priority Data

Apr. 24, 2015 (JP) ..... 2015-088935
Oct. 23, 2015 (JP) ..... 2015-208808

(51) Int. Cl.

| | |
|---|---|
| ***G05G 1/00*** | (2006.01) |
| ***G05G 9/047*** | (2006.01) |
| ***H01H 25/04*** | (2006.01) |
| ***G05G 5/05*** | (2006.01) |

(52) U.S. Cl.

CPC ..... *G05G 9/047* (2013.01); *G05G 5/05* (2013.01); *H01H 25/04* (2013.01); *G05G 2009/04703* (2013.01); *G05G 2009/04748* (2013.01); *G05G 2009/04777* (2013.01)

(58) Field of Classification Search

CPC ..... G05G 9/047; G05G 5/05; G05G 2009/04703; G05G 2009/04748; G05G 2009/04777; H01H 25/04

See application file for complete search history.

(56) References Cited

U.S. PATENT DOCUMENTS

2006/0125790 A1* 6/2006 Edmunds ..... G05G 9/047 345/161
2006/0290669 A1* 12/2006 Ishimaru ..... G05G 9/047 345/161

(Continued)

FOREIGN PATENT DOCUMENTS

JP 2013-65398 4/2013

*Primary Examiner* — Zakaria Elahmadi
(74) *Attorney, Agent, or Firm* — Nixon & Vanderhye P.C.

(57) ABSTRACT

An operating member 3 has a shaft portion 31 and a fulcrum portion 32. A first swinging member 4 has a concave fitting portion 42. Inside the fitting portion, engaging surfaces and guide surfaces 45, 46 are included. The engaging surfaces are formed to be engageable with the fulcrum portion. The guide surfaces allow the fulcrum portion to swing with respect to the first swinging member. The second swinging member 5 includes an engaging portion 63 which includes a long hole, and which covers the fulcrum portion while passing the shaft portion through the long hole in a manner that the shaft portion is movable in the longitudinal direction of the long hole, in such a manner that the engaging portion and the fitting portion cooperate to sandwich the fulcrum portion. The engaging portion is coupled with the second swing shaft, and configured to be engageable with the shaft portion.

15 Claims, 25 Drawing Sheets

(56) References Cited

U.S. PATENT DOCUMENTS

| | | | | |
|---|---|---|---|---|
| 2007/0029176 | A1* | 2/2007 | Sakurai | G05G 9/047 200/6 A |
| 2007/0170046 | A1* | 7/2007 | Ito | G05G 1/02 200/11 R |
| 2012/0152052 | A1* | 6/2012 | Suzuki | G05G 9/047 74/504 |
| 2012/0274563 | A1* | 11/2012 | Olsson | G05G 9/047 345/161 |
| 2015/0031457 | A1* | 1/2015 | Togawa | G06F 3/0338 463/38 |
| 2015/0031458 | A1* | 1/2015 | Yoguchi | H01H 25/06 463/38 |
| 2017/0001106 | A1* | 1/2017 | Gassoway | G06F 3/0338 |
| 2017/0032904 | A1* | 2/2017 | Fujimoto | H01H 9/18 |

* cited by examiner

MULTI-DIRECTIONAL INPUT DEVICE

This application claims priority to JP Patent Application No. 2015-088935 filed 24 Apr. 2015, and JP Patent Application No. 2015-208808 filed 23 Oct. 2015, the entire contents of each of which are hereby incorporated by reference.

TECHNICAL FIELD

The present invention relates to a multi-directional input device.

BACKGROUND ART

Conventionally, for example, a multi-directional input device disclosed in Patent Literature 1 has been known. The multi-directional input device disclosed in Patent Literature 1 includes: a housing having an opening; an operating member in which an operating portion is exposed from the opening, and which is tiltably operable; and first and second interlocking members which are swung in accordance with a tilting operation of the operating member, and which are held in the housing so that the swing axes of the members extend to perpendicularly intersect with other.

The first and second interlocking members are produced by using an insulating resin, and disposed with respect to a shaft portion of the operating member so that the first interlocking member is located below the second interlocking member. The operating member is coupled to each of the first and second interlocking members, and rotatably supported by the first interlocking member.

In the multi-directional input device disclosed in Patent Literature 1, in order to enable the operating member to be coupled (engaged) with each of the first and second interlocking members, however, a through hole must be disposed in each of the interlocking members. Therefore, there is a case where the rigidities of the interlocking members cannot be sufficiently ensured. This may cause a problem in product strength, and is not preferable.

PRIOR ART LITERATURE

Patent Literature

Patent Literature 1: Japanese Patent Application Laid-Open No. 2013-65398

SUMMARY OF THE INVENTION

Problems to be Solved by the Invention

The invention has been conducted in view of the above-discussed circumstances. It is an object of the invention to provide a multi-directional input device in which the rigidity of a swinging member that is moved in conjunction with an operating member can be improved.

Means for Solving the Problems

According to one aspect of the invention, a multidirectional input device includes:

a case;

a tiltable operating member which is projected from an interior to an outside of the case;

a first swinging member which has a first swing shaft, and which is held in the case to be swingable about the first swing shaft in accordance with a tilting operation of the operating member;

a second swinging member which has a second swing shaft that extends in a direction perpendicular to an axial direction of the first swing shaft, and which is held in the case to be swingable about the second swing shaft in accordance with the tilting operation of the operating member;

first and second detecting devices which are configured to detect swinging operations of the first and second swinging members, respectively; and a returning member for returning the operating member to an origin.

The operating member has:

a shaft portion which is inserted into the case from an upper side; and a fulcrum portion which is coupled to an insertion end part of the shaft portion, the first swinging member has a concave fitting portion which is integrally swingably coupled with the first swing shaft, and which is formed to allow the fulcrum portion of the operating member to be fittable into the fitting portion from a lower side, and, inside the fitting portion, includes: engaging surfaces which are formed to be engageable with the fulcrum portion in an axial direction of the second swinging member; and guide surfaces which allow the fulcrum portion to swing about the axial direction of the second swing shaft with respect to the first swinging member, and the second swinging member has:

an engaging portion which includes a long hole extending in the axial direction of the second swing shaft, and which covers the fulcrum portion of the operating member from an upper side while passing the shaft portion through the long hole in a manner that the shaft portion is movable in a longitudinal direction of the long hole, in such a manner that the engaging portion and the fitting portion cooperate to vertically sandwich the fulcrum portion, the engaging portion being integrally swingably coupled with the second swing shaft, and the engaging portion being engageable with the shaft portion in the axial direction of the first swing shaft.

According to the configuration, when the operating member is tilted, the first swinging member and the second swinging member can be swung independently from each other in accordance with the tilting operation of the operating member. When the operating member is tilted in the axial direction of the second swing shaft, for example, the fulcrum portion of the operating member is engaged with the fitting portion of the first swinging member, and the first swinging member can be swung about the first swing shaft so as to be moved in conjunction with the operating member. In this case, in the operating member, the shaft portion is moved along the long hole, and therefore the second swinging member is not swung. When the operating member is tilted in the axial direction of the first swing shaft, the shaft portion of the operating member is engaged with the engaging portion of the second swinging member, and the second swinging member can be swung about the second swing shaft so as to be moved in conjunction with the operating member. In this case, the operating member causes the fulcrum portion to be swung relative to the fitting portion, and therefore the first swinging member is not swung. Therefore, the swinging operations of the first and second swinging members are detected by the first and second detecting devices, respectively, and the tilt amount of the operating member can be sensed.

Even in the case where the operating member is being returned to the origin, the fulcrum portion of the operating member can be engaged in the axial direction of the second swing shaft with one of the engaging surfaces of the fitting portion in the state where the fulcrum portion is fitted into the fitting portion of the first swinging member. Therefore, rotation of the operating member about the shaft portion can be restricted. Moreover, the structure in which the fulcrum portion is fitted into the fitting portion in order to perform the engagement is employed. In the first swinging member, therefore, it is not necessary to dispose a through hole for engagement with the operating member, and the rigidity of the first swinging member can be improved. As a result, the product strength of the multi-directional input device can be enhanced, and, for example, torsional rotation of the operating member can be surely prevented from occurring.

According to another aspect of the invention, one of the fulcrum portion of the operating member and the engaging portion of the second swinging member includes a concave part, another one of the fulcrum portion and the engaging portion includes a convex part, and, when the concave part and the convex part are engaged with each other, the engaging portion restricts an upward movement of the fulcrum portion.

According to a further aspect of the invention, the multi-directional input device further includes a depression switch which has a pusher that is accommodated in the case to be vertically movable, and a snap type contact member that upwardly urges the pusher, the depression switch being able to detect depression of the operating member.

The operating member is able to be depressed to downwardly move the first swinging member, and, in the depression switch, the pusher is downwardly moved by the first swinging member which is downwardly moved by depression of the operating member, against an urging force of the contact member, and the contact member is pushed by the pusher.

According to a still further aspect of the invention, each of the first and second detecting devices is configured by using:

a slider of a straight-ahead type which straightly moves on a circuit board in the case, in accordance with swinging of the first swinging member or the second swinging member due to tilting of the operating member; and a sliding variable resistor configured by a resistance circuit formed on the circuit board, and a contactor which is attached to an opposing surface of the slider, the opposing surface being opposed to the circuit board, the contactor sliding on and contacting with the resistance circuit.

According to a still further aspect of the invention, each of the first swinging member and the second swinging member has an operation projection which, in order to enable the slider to move, converts a swinging movement of the first swinging member or the second swinging member to a linear movement, the operation projections of the first swinging member and the second swinging member are disposed on a bottom portion of the case, and the first swing shaft and the second swing shaft are placed in a ceiling portion of the case.

According to a still further aspect of the invention, the operating member is configured to be depressable to cause the first swinging member to be downwardly moved, the first swinging member has:

an operation projection which, in order to enable the slider to move, converts a swinging movement of the first swinging member to a linear movement, and the slider has:

a concave portion which vertically movably accommodates the operation projection so as to be engaged with the operation projection in a movement direction of the slider.

According to a still further aspect of the invention, the first swinging member further includes a supporting surface which, in the fitting portion, is formed to be contactable with the fulcrum portion of the operating member so as to support the fulcrum portion from a lower side, and the fulcrum portion of the operating member is fitted into the fitting portion to contact with the engaging surfaces, the guide surfaces, and the supporting surface that are in an inner side of the fitting portion.

According to the configuration, when the fulcrum portion of the operating member is fitted into the fitting portion of the first swinging member, the fulcrum portion can is caused to bump the guide surfaces and the engaging surfaces, to be supported thereby, and further hit the supporting surface which is located below the fulcrum portion, to be supported thereby. When an impact is axially applied to the operating member from the side opposite to the fulcrum portion across the shaft portion because, for example, an apparatus on which the multi-directional input device is mounted falls, therefore, it is possible to effectively mitigate an impact which is transmitted from the operating member to the fitting portion through the fulcrum portion. Therefore, the impact resistance property of the first swinging member can be improved.

According to a still further aspect of the invention, the fulcrum portion of the operating member is placed to, in a case of fitting into the fitting portion, be in contact with a whole area of the inner side of the fitting portion.

Effects of the Invention

According to the invention, it is possible to provide a multi-directional input device in which the rigidity of a swinging member that is moved in conjunction with an operating member can be improved.

DESCRIPTION OF PREFERRED EMBODIMENTS

First, a first embodiment of the invention will be described with reference to the drawings.

Figure 1:
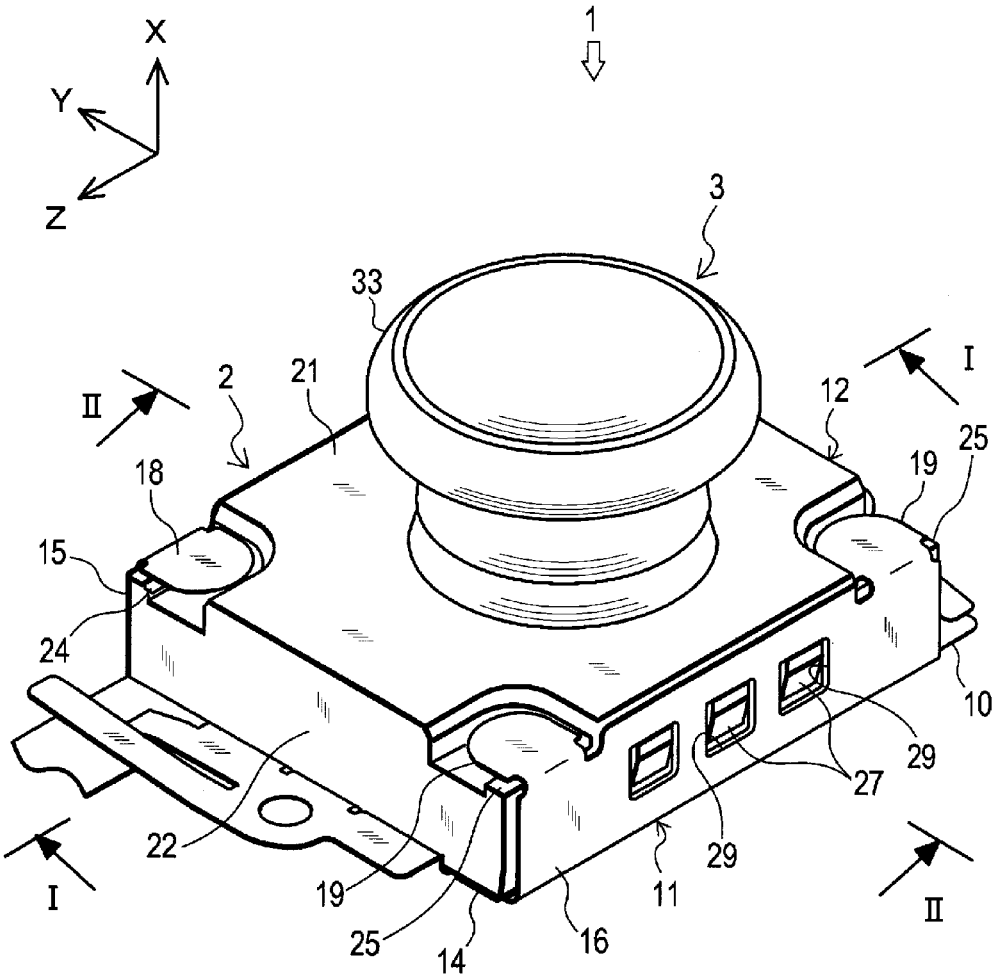
FIG. 1 is a front perspective view of a multidirectional input device of a first embodiment of the invention.
Figure 2:
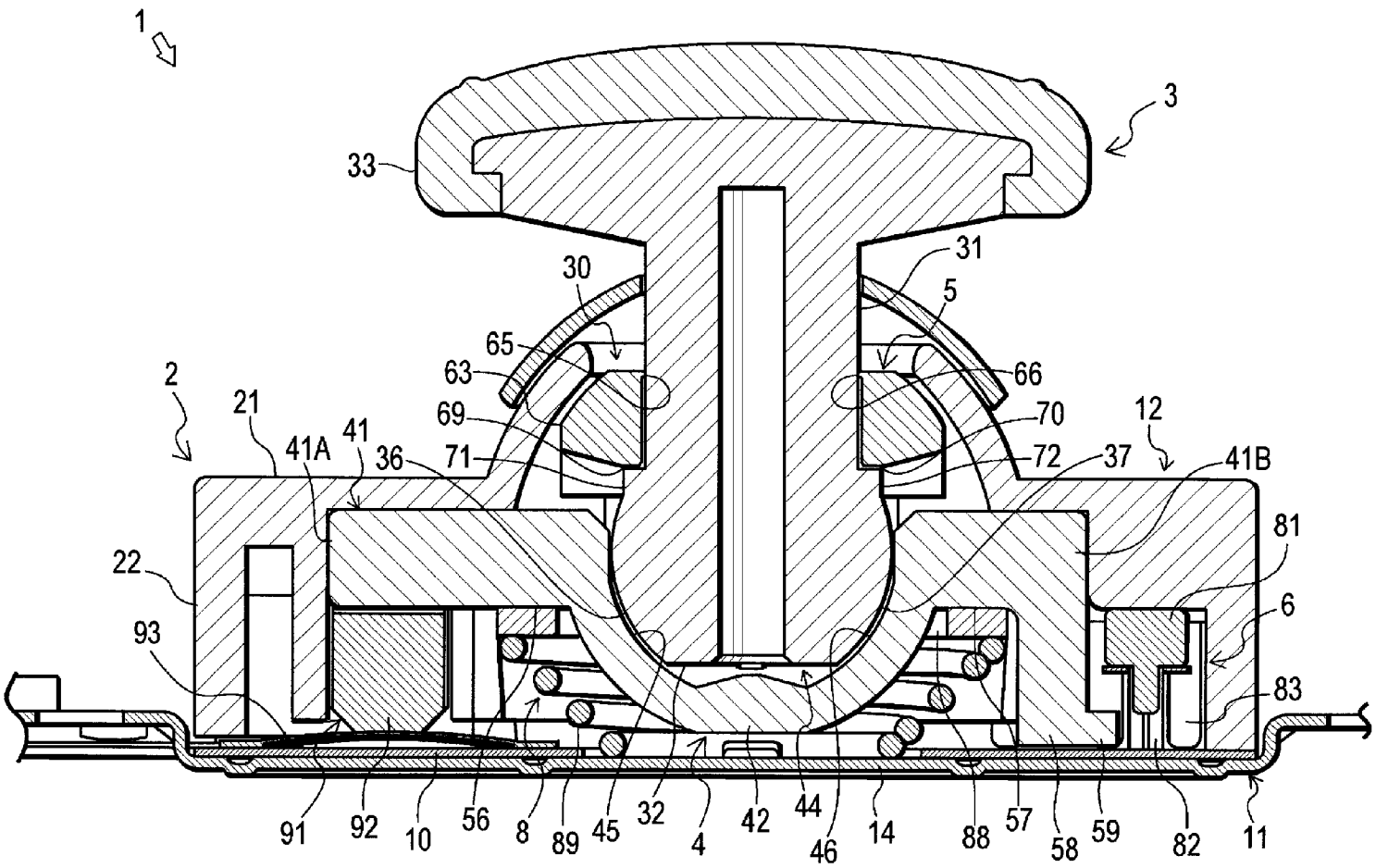
FIG. 2 is a sectional view as seen in the direction of arrows I-I in FIG. 1.
Figure 3:
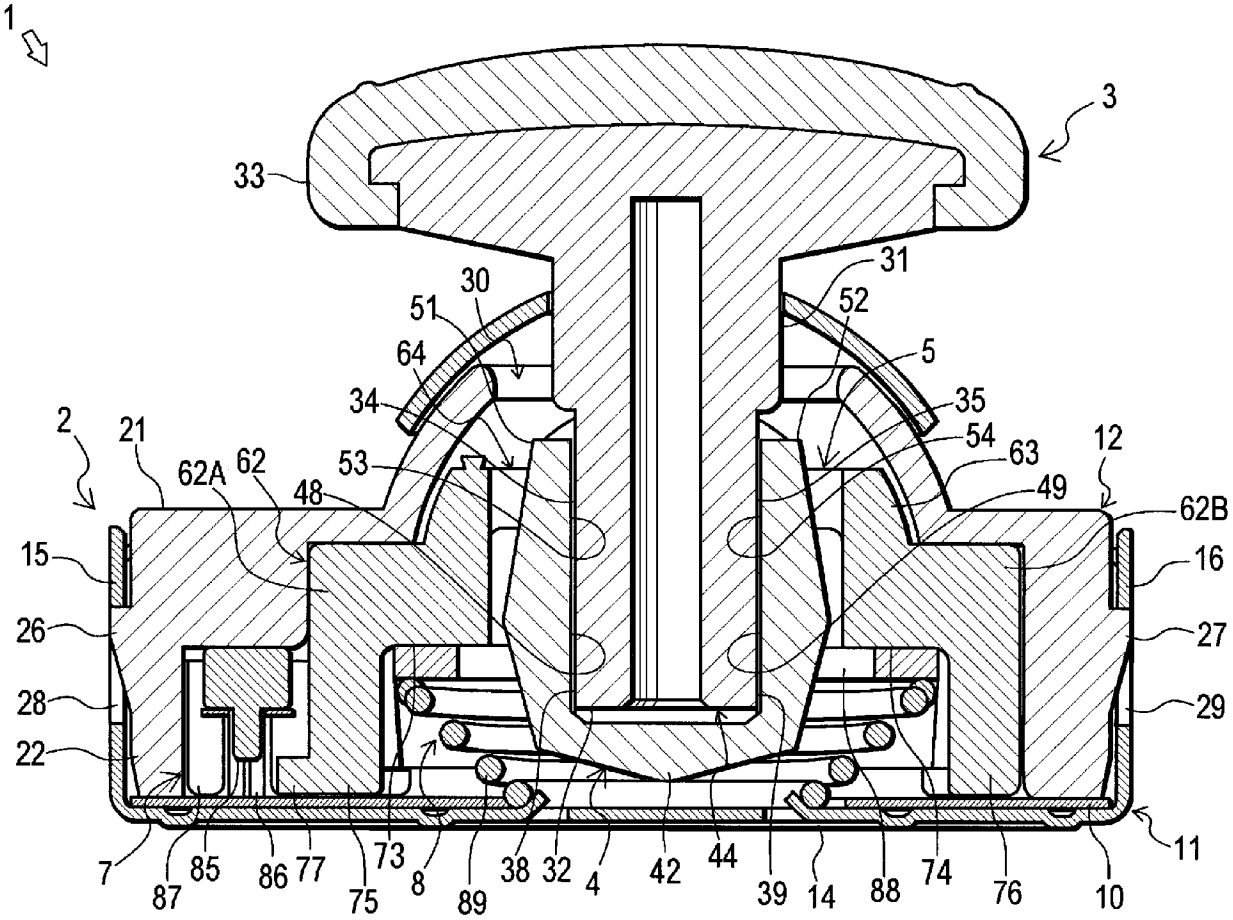
FIG. 3 is a sectional view as seen in the direction of arrows II-II in FIG. 1.
Figure 4:
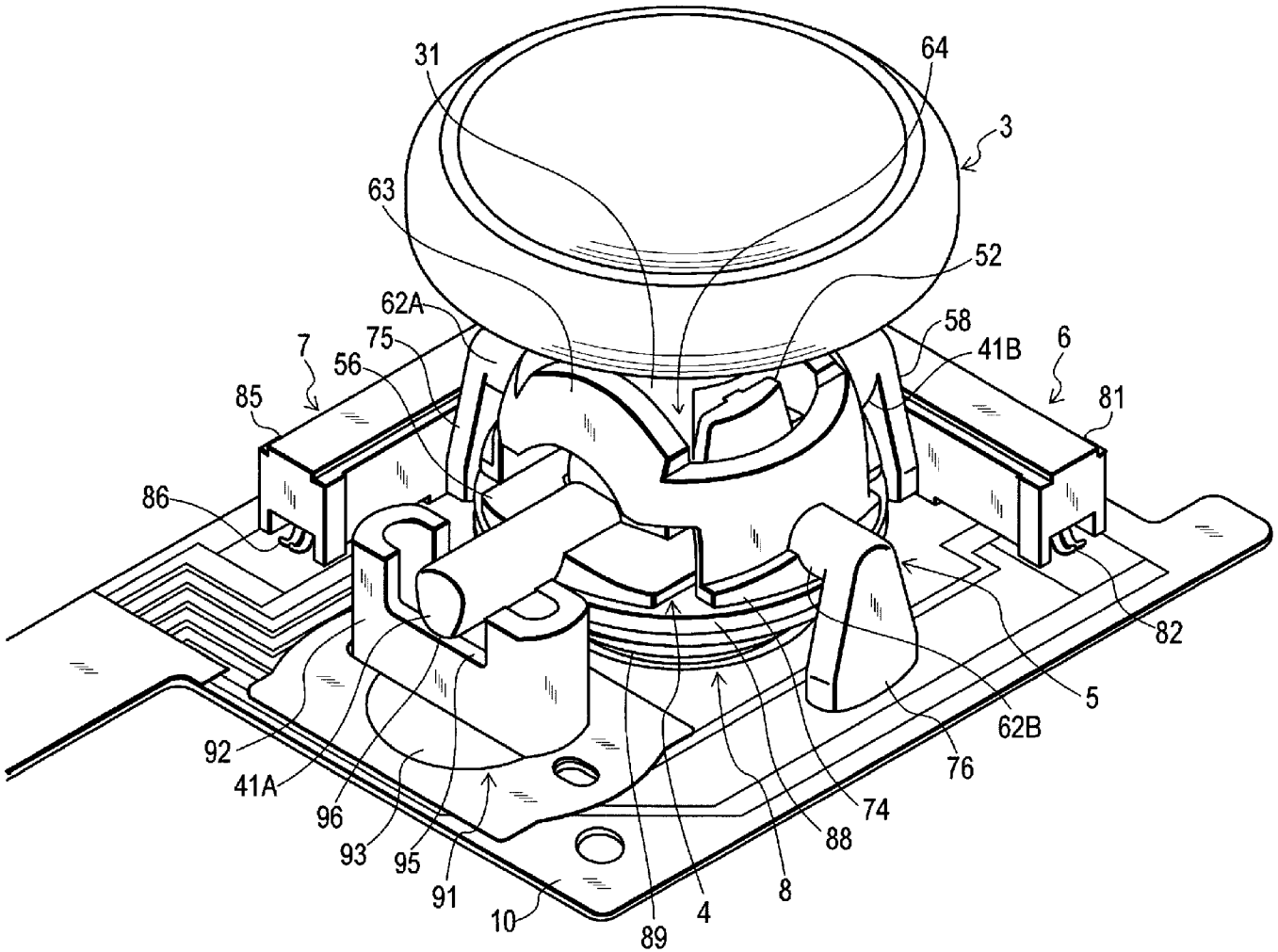
FIG. 4 is a front perspective view showing a state where a case is removed from the multi-directional input device of FIG. 1.

FIG. 1 is a front perspective view of a multidirectional input device 1 of the first embodiment of the invention, FIG. 2 is a sectional view as seen in the direction of arrows I-I in FIG. 1, FIG. 3 is a sectional view as seen in the direction of arrows II-II in FIG. 1, and FIG. 4 is a front perspective view showing a state where a case 2 is removed from the multi-directional input device 1 of FIG. 1. In the multi-directional input device 1, it is assumed that, in FIG. 1, the direction of the arrow X is the upward direction, that of the arrow Y is the leftward direction, and that of the arrow Z is the forward direction.

The multi-directional input device 1 of the embodiment may be used in various electronic apparatuses such as a controller for a gaming machine. As shown in FIGS. 1 to 4, the multi-directional input device 1 includes the case 2, an operating member 3, a first swinging member 4, a second swinging member 5, a first detecting device 6, a second detecting device 7, and a returning member 8.

The case 2 can accommodate the first swinging member 4 and the second swinging member 5, and also a circuit board 10 (for example, a well-known printed circuit board) and the like. In the embodiment, the case 2 has a lower case 11 and an upper case 12, and is formed so as to, when the lower case 11 and the upper case 12 are combined to each other, have a box-like shape.

The lower case 11 includes a bottom plate portion 14 and left and right sidewall portions 15, 16, and is formed into a concave shape as viewed from the front side (see FIG. 3). The bottom plate portion 14 is formed into a rectangular planar shape. The left and right sidewall portions 15, 16 are erected from left and right edge portions of the periphery of the bottom plate portion 14, respectively, extend in the anteroposterior direction, and are placed so as to be opposed to each other.

In an upper end part of the left sidewall portion 15 of the left and right sidewall portions 15, 16, a pair of left nail portions 18 are disposed so as to be rightwardly projected from the vicinities of the front and rear ends, respectively. In an upper end part of the right sidewall portion 16 of the left and right sidewall portions 15, 16, a pair of right nail portions 19 are disposed so as to be leftwardly projected from the vicinities of the front and rear ends, respectively.

The upper case 12 includes a top plate portion 21 and a sidewall portion 22 which surrounds the top plate portion 21, and is formed into a cap-like shape which has a rectangular boxy form, and which is downwardly opened. The upper case 12 is placed so as to cover the bottom plate portion 14 of the lower case 11, and fitted between the left and right sidewall portions 15, 16 of the lower case 11 so as to be able to be held therebetween.

In a left edge portion of the periphery of the top plate portion 21, a pair of engaging concave portions 24 which are formed so as to be engageable respectively with the pair of left nail portions 18 disposed in the left sidewall portion 15 are disposed. In a right edge portion of the periphery of the top plate portion 21, a pair of engaging concave portions 25 which are formed so as to be engageable respectively with the pair of right nail portions 19 disposed in the right sidewall portion 16 are disposed.

As described above, the case 2 is configured so that, when the upper case 12 is overlaid on the lower case 11 to be combined therewith, the pair of left nail portions 18 and pair of right nail portions 19 of the lower case 11 are engaged with the corresponding engaging concave portions 24, 25 of the upper case 12, respectively, and the lower case 11 and the upper case 12 can be fixed to each other.

In the embodiment, furthermore, a plurality of nail portions 26, 27 are disposed on the sidewall portion 22 of the upper case 12, engaging holes 28, 29 which are engageable with the nail portions 26, 27 are disposed on the left and right sidewall portions 15, 16 of the lower case 11, respectively, and the lower case 11 and the upper case 12 can be fixed more strongly to each other by their engagement.

The upper case 12 further includes a through hole 30 in a substantially middle part of the top plate portion 21, and is configured so that the operating member 3 can be passed through the through hole 30. The through hole 30 is configured by a circular hole having a predetermined diameter which does not impede the operation of the operating member 3 that is passed through the through hole 30, formed so as to be upwardly and downwardly opened, and covered with an elastic cover.

Figure 5:
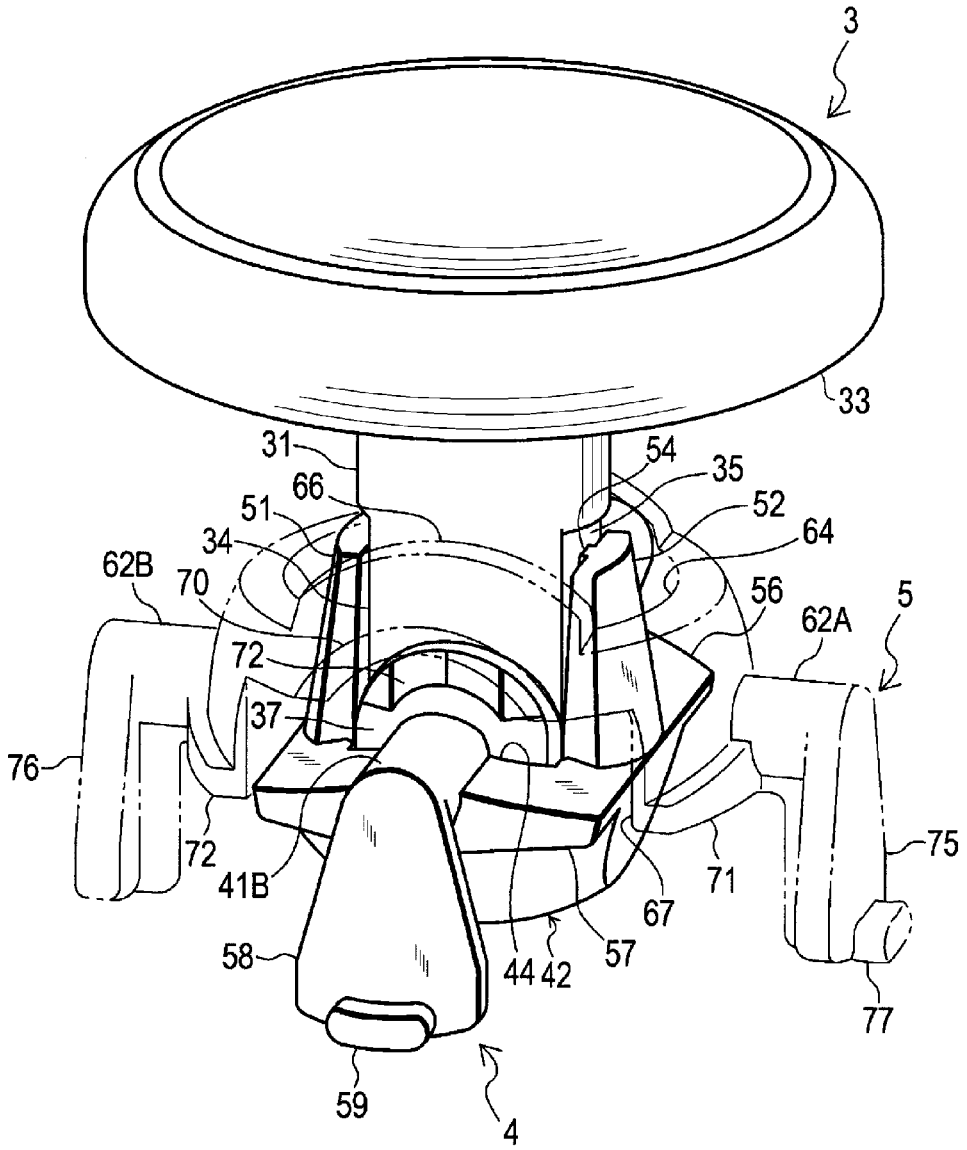
FIG. 5 is a rear perspective view showing a state where an operating member, first swinging member, and second swinging member in the multi-directional input device of FIG. 1 are combined with one another.
Figure 6:
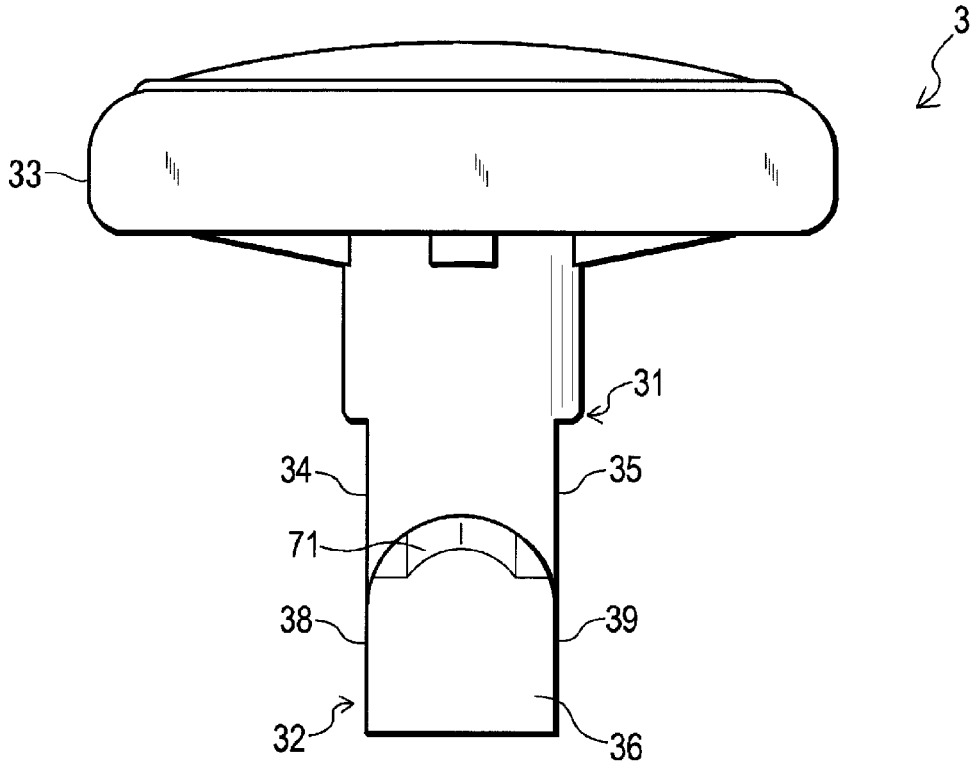
FIG. 6 is a front view of the operating member of the multi-directional input device of FIG. 5.
Figure 7:
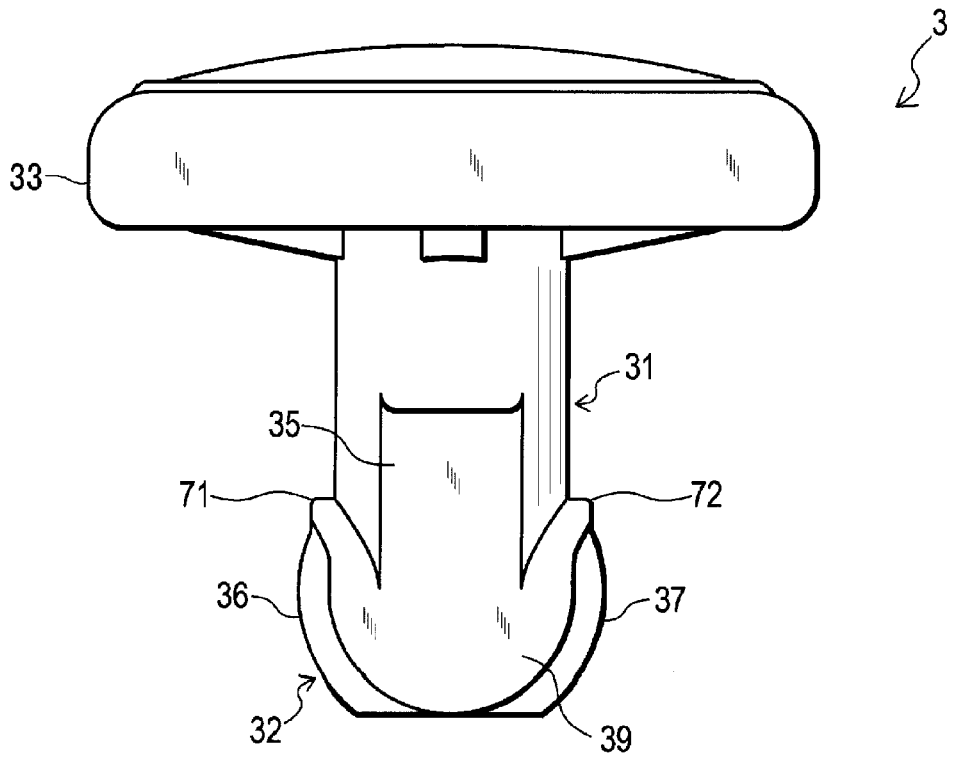
FIG. 7 is a right side view of the operating member of the multi-directional input device of FIG. 5.
Figure 8:
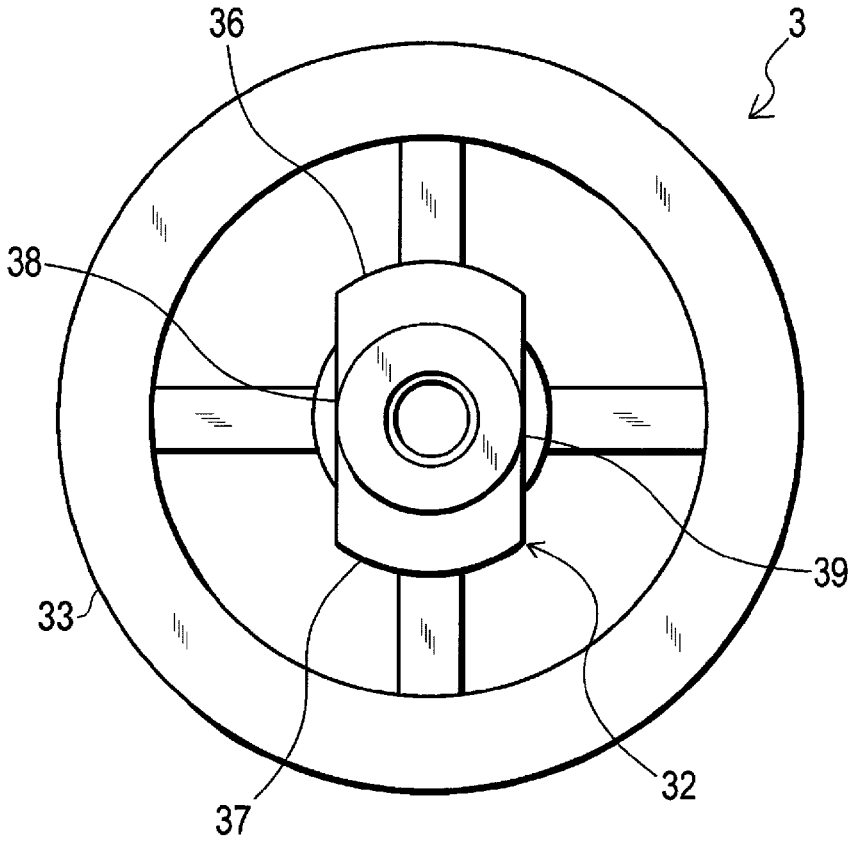
FIG. 8 is a bottom plan view of the operating member of the multi-directional input device of FIG. 5.

FIG. 5 is a rear perspective view showing a state where the operating member 3, the first swinging member 4, and the second swinging member 5 are combined with one another, FIG. 6 is a front view of the operating member 3, FIG. 7 is a right side view of the operating member 3, and FIG. 8 is a bottom plan view of the operating member 3.

The operating member 3 is projected to the outside from the interior of the case 2, and configured so as to, in the projected state, be tiltable. As shown also in FIGS. 5 to 8, the operating member 3 has a shaft portion 31 which is inserted into the case 2, and a fulcrum portion 32 which is coupled to an insertion end part (lower end part) of the shaft portion 31. In the embodiment, the operating member 3 is made of an insulating resin, and further has a head portion 33.

The shaft portion 31 is placed so to be relatively movable with respect to the upper case 12. Specifically, the shaft portion 31 is formed into a round rod-like shape which is smaller in diameter than the through hole 30. The shaft portion 31 is passed through the through hole 30 so that the longitudinal direction is set in the vertical direction, and the shaft portion is displaceable between the center position (initial reference position) of the through hole 30, and a predetermined position in the radially outer side.

The shaft portion 31 has a left engaging surface 34 configured by a substantially flat surface (substantially vertical surface), and a right engaging surface 35 configured by a substantially flat surface (substantially vertical surface). The left engaging surface 34 is formed so as to face the left side, by cutting away a left lower part of the shaft portion 31. The right engaging surface 35 is formed so as to face the right side, by cutting away a right lower part of the shaft portion 31.

The fulcrum portion 32 is a portion which, when the operating member 3 is tilted, functions as a fulcrum in the tilting operation, and has an anteroposterior width which is larger than that of the shaft portion 31. The outer surface of the fulcrum portion 32 includes a front swelling surface 36 configured by an arcuate surface which is forwardly convex, and a rear swelling surface 37 configured by an arcuate surface which is rearwardly convex, and is formed so as to exhibit a semispherical shape which is downwardly convex as viewed from the lateral side (see FIG. 7).

The outer surface of the fulcrum portion 32 has a left engaging surface 38 configured by a substantially flat surface (substantially vertical surface), and a right engaging surface 39 configured by a substantially flat surface (substantially vertical surface). The left engaging surface 38 is continuously formed so as to be located in a plane which is substantially identical with the left engaging surface 34 of the shaft portion 31. The right engaging surface 39 is continuously formed so as to be located in a plane which is substantially identical with the right engaging surface 35 of the shaft portion 31.

Figure 9:
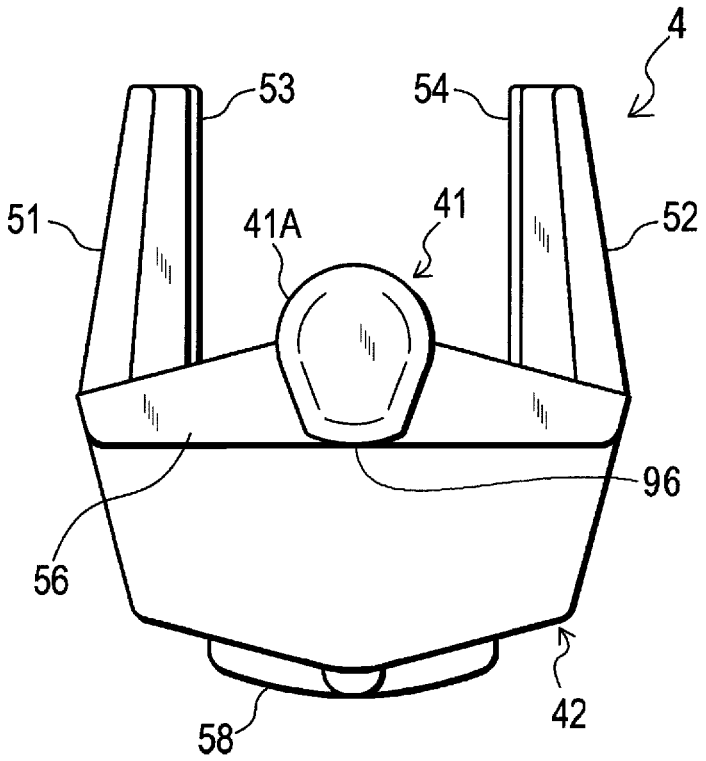
FIG. 9 is a front view of the first swinging member of the multi-directional input device of FIG. 5.
Figure 10:
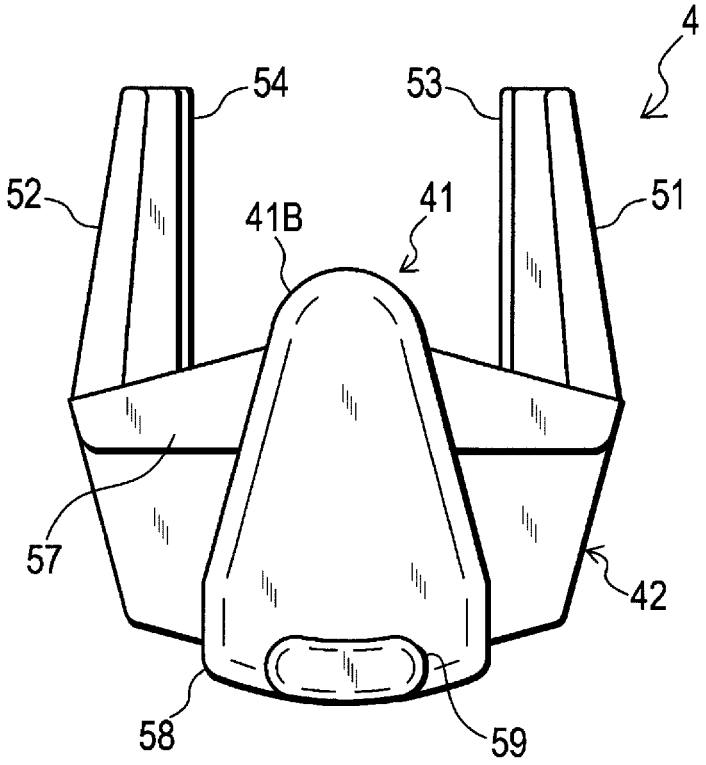
FIG. 10 is a rear view of the first swinging member of the multi-directional input device of FIG. 5.
Figure 11:
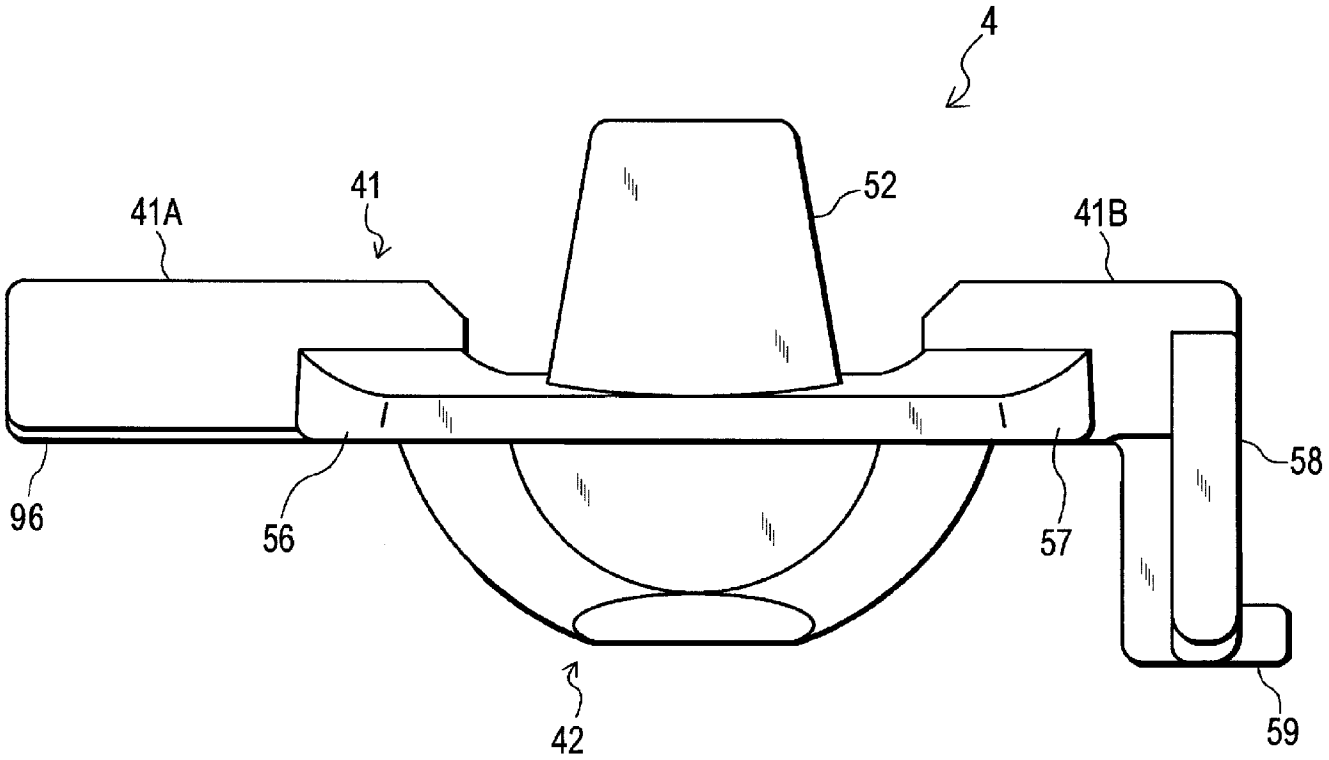
FIG. 11 is a right side view of the first swinging member of the multi-directional input device of FIG. 5.
Figure 12:
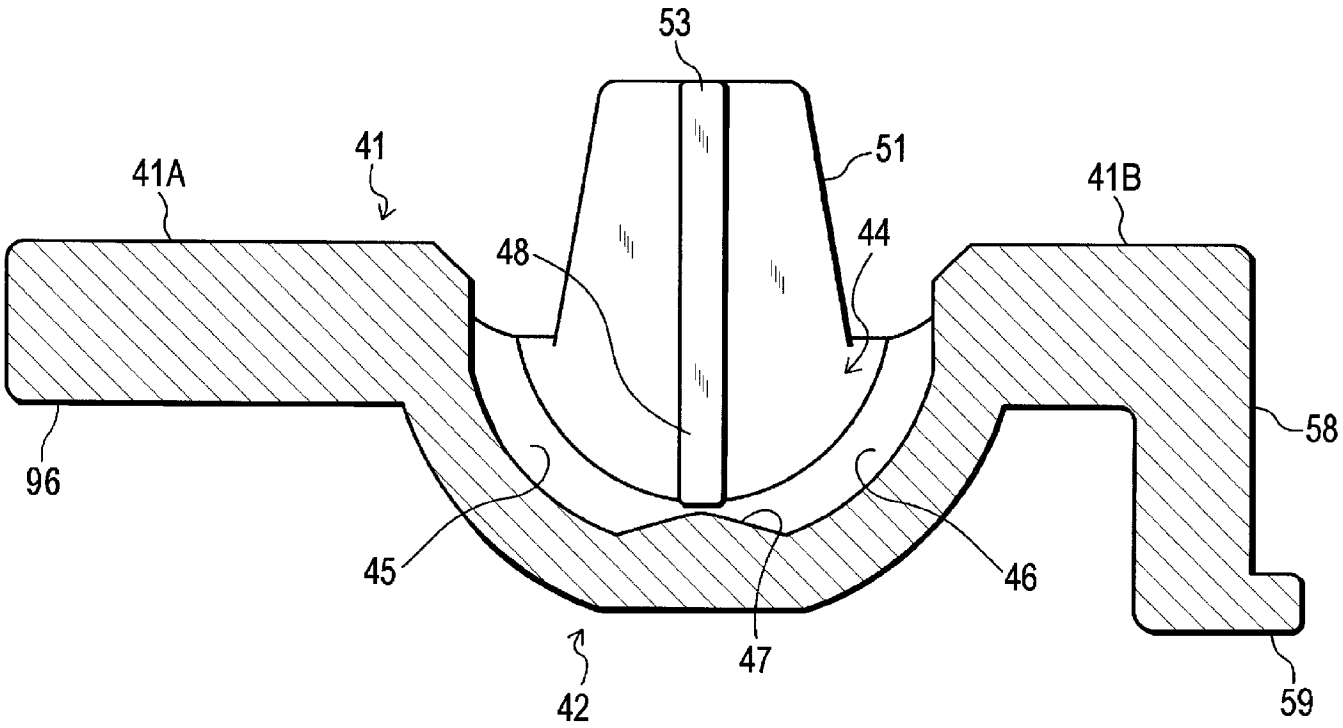
FIG. 12 is a right side sectional view of the first swinging member of the multi-directional input device of FIG. 5.
Figure 13:
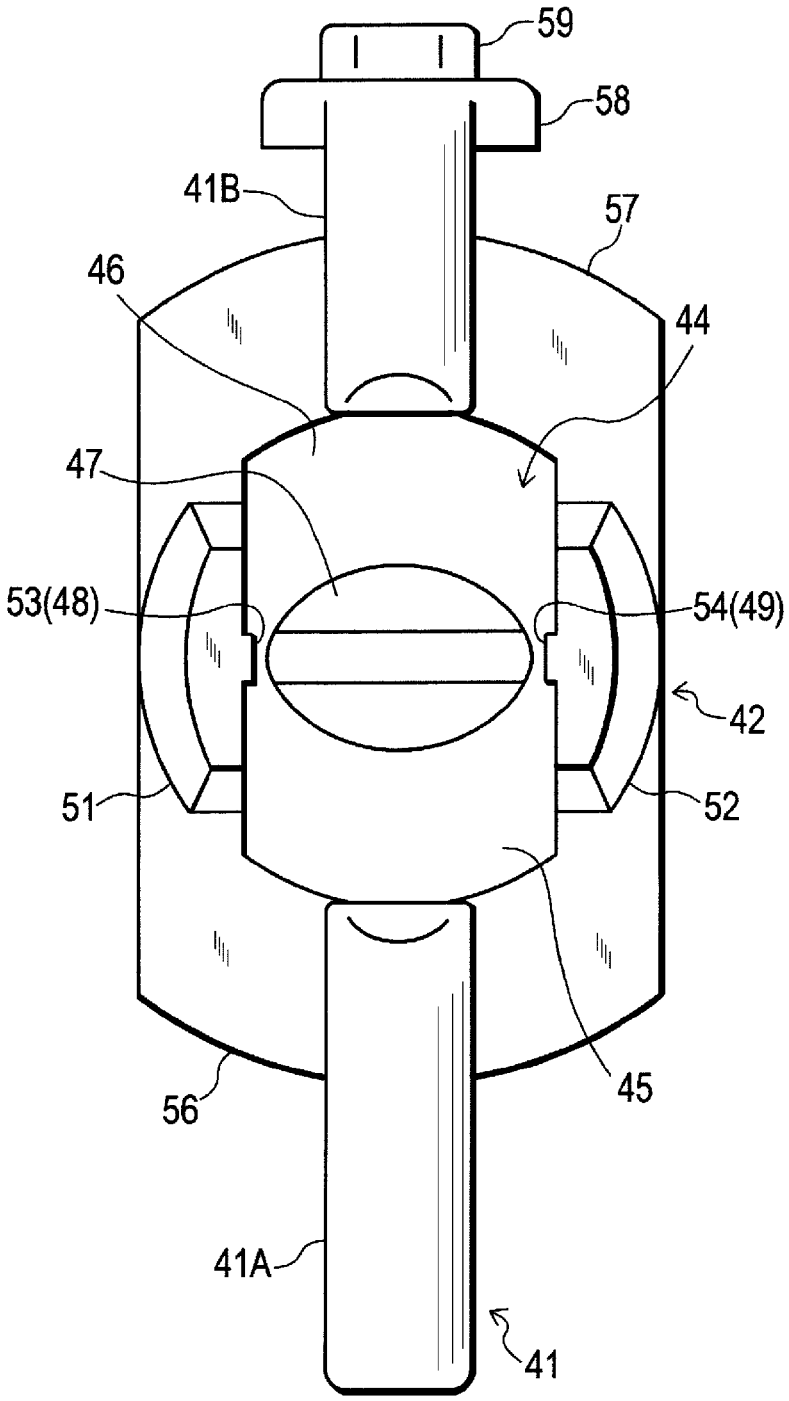
FIG. 13 is a top plan view of the first swinging member of the multi-directional input device of FIG. 5.

FIG. 9 is a front view of the first swinging member 4, FIG. 10 is a rear view of the first swinging member 4, FIG. 11 is a right side view of the first swinging member 4, FIG. 12 is a right side sectional view of the first swinging member 4, and FIG. 13 is a top plan view of the first swinging member 4.

As shown also in FIGS. 9 to 13, the first swinging member 4 has a first swing shaft 41 in which the axial direction coincides with the anteroposterior direction, and is held in the case 2 so as to swing about the first swing shaft 41 in accordance with a tilting operation of the operating member 3. The first swinging member 4 further has a concave fitting portion 42 which is integrally swingably coupled with the first swing shaft 41.

The fitting portion 42 is fittable to the fulcrum portion 32 of the operating member 3 from the lower side, and, inside the fitting portion 42, includes: front and rear guide surfaces 45, 46 which allow the fulcrum portion 32 to swing about the axial direction of the second swing shaft with respect to the first swinging member 4; and left and right engaging surfaces 48, 49 which are engageable with the fulcrum portion 32 in the axial direction of the second swinging member.

In the embodiment, the first swinging member 4 is made of an insulating resin, and placed above the bottom plate portion 14 (the circuit board 10) of the lower case 11. The first swing shaft 41 is placed while setting the axial direction coincident with the anteroposterior direction, and configured by a front shaft portion 41A and a rear shaft portion 41B. Each of the front and rear shaft portions 41A, 41B is formed into a round rod-like shape.

The front and rear shaft portions 41A, 41B are coaxially placed so as to sandwich the fitting portion 42 in the anteroposterior direction while setting the respective axial directions coincident with a substantially horizontal direction, and disposed to be swingable with respect to the upper case 12. The front and rear shaft portions 41A, 41B are integrally swingably coupled with the fitting portion 42 in respective axial end parts.

The fitting portion 42 is configured by a hollow semispherical member which is downwardly convex, and includes a fitting hole 44 which is upwardly opened. The fitting hole 44 has an inner surface having a shape which extends along the front and rear swelling surfaces 36, 37 and left and right engaging surfaces 38, 39 of the fulcrum portion 32 of the operating member 3, and is formed so that the fulcrum portion 32 can be fitted to the hole with substantially no space therebetween.

That is, the inner surface of the fitting hole 44 includes the front guide surface 45 configured by an arcuate surface which is forwardly concave, and the rear guide surface 46 configured by an arcuate surface which is rearwardly concave, and is formed so as to exhibit a semispherical shape which is downwardly concave as viewed from the lateral side (see FIG. 12). A lower swelling surface 47 is disposed in a bottom portion of the hole to thicken the bottom of the fitting portion 42.

The inner surface of the fitting hole 44 further includes the left engaging surface 48 configured by a substantially flat surface (substantially vertical surface), and the right engaging surface 49 configured by a substantially flat surface (substantially vertical surface). The left engaging surface 48 is formed so as to be engageable with the left engaging surface 38 of the fulcrum portion 32. The right engaging surface 49 is formed so as to be engageable with the right engaging surface 39 of the fulcrum portion 32.

The first swinging member 4 further has a left engaging portion 51 and a right engaging portion 52. The left and right engaging portions 51, 52 are disposed so as to be upwardly projected from the fitting portion 42, and configured so that, when the fulcrum portion 32 is fitted into the fitting hole 44 and fitted into the fitting portion 42, the operating member 3 can be laterally sandwiched between the engaging portions.

Specifically, the left engaging portion 51 is erected from the left upper surface of the fitting portion 42, and includes a left engaging surface 53 configured by a substantially flat surface (substantially vertical surface). The left engaging surface 53 is placed so as to face in the rightward direction in the left engaging portion 51, and continuously formed so as to be located in a plane which is substantially identical with the left engaging surface 48 of the fitting portion 42.

The right engaging portion 52 is erected from the right upper surface of the fitting portion 42, and includes a right engaging surface 54 configured by a substantially flat surface (substantially vertical surface). The right engaging surface 54 is placed so as to face in the leftward direction in the right engaging portion 52, and continuously formed so as to be located in a plane which is substantially identical with the right engaging surface 49 of the fitting portion 42.

The left and right engaging portions 51, 52 are upwardly projected to a substantially same level (vertical position) from the fitting portion 42, and disposed so that, when the first swinging member 4 and the second swinging member 5 are combined with each other, the projected end parts (upper end parts of the left and right engaging surfaces 53, 54) of the left and right engaging portions 51, 52 are located at an approximately same level as an upper end part of the second swinging member 5.

The first swinging member 4 has a front supporting portion 56 and a rear supporting portion 57. Each of the front and rear supporting portions 56, 57 includes a lower surface configured by a substantially flat surface (substantially horizontal surface). The front and rear supporting portions are placed on the front and rear sides of the fitting portion 42, respectively so that the lower surfaces are located at a substantially same level, and at substantially the same level as or lower than the front and rear shaft portions 41A, 41B.

Specifically, the front supporting portion 56 is disposed so as to be forwardly projected from an upper part of the fitting portion 42 along the front shaft portion 41A, and placed on both the lateral sides of the front shaft portion 41A. The rear supporting portion 57 is disposed so as to be rearwardly projected from an upper part of the fitting portion 42 along the rear shaft portion 41B, and placed on both the lateral sides of the rear shaft portion 41B.

The first swinging member 4 further has a first elongated portion 58. The first elongated portion 58 is disposed so as to be downwardly elongated from the other axial end part (rear end part) of the rear shaft portion 41B. The first elongated portion 58 is formed into a sector shape as viewed from the rear side, and integrally swingably fixed to the rear shaft portion 41B so that a lower end part corresponding to the arcuate part of the shape is not contacted with the circuit board 10.

The lower end part of the first elongated portion 58 includes a first operation projection 59. The first operation projection 59 functions to convert the swinging movement of the rear shaft portion 41B (the first swinging member 4) to a linear movement, and, when the first elongated portion 58 is swung integrally with the rear shaft portion 41B, is laterally displaceable. The first operation projection 59 is formed into an arcuate shape which extends along the arcuate part of the first elongated portion 58.

Figure 14:
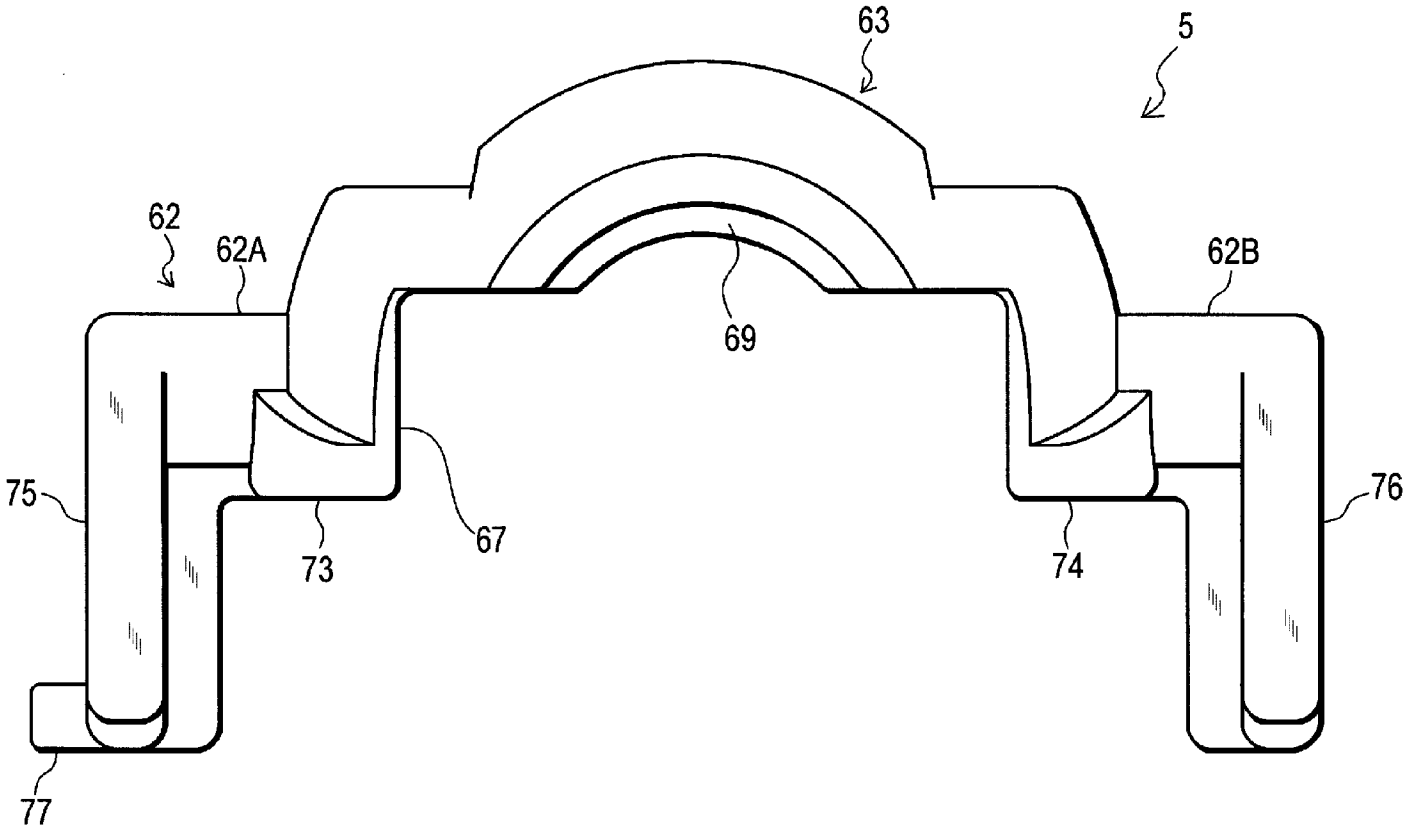
FIG. 14 is a front view of the second swinging member of the multi-directional input device of FIG. 5.
Figure 15:
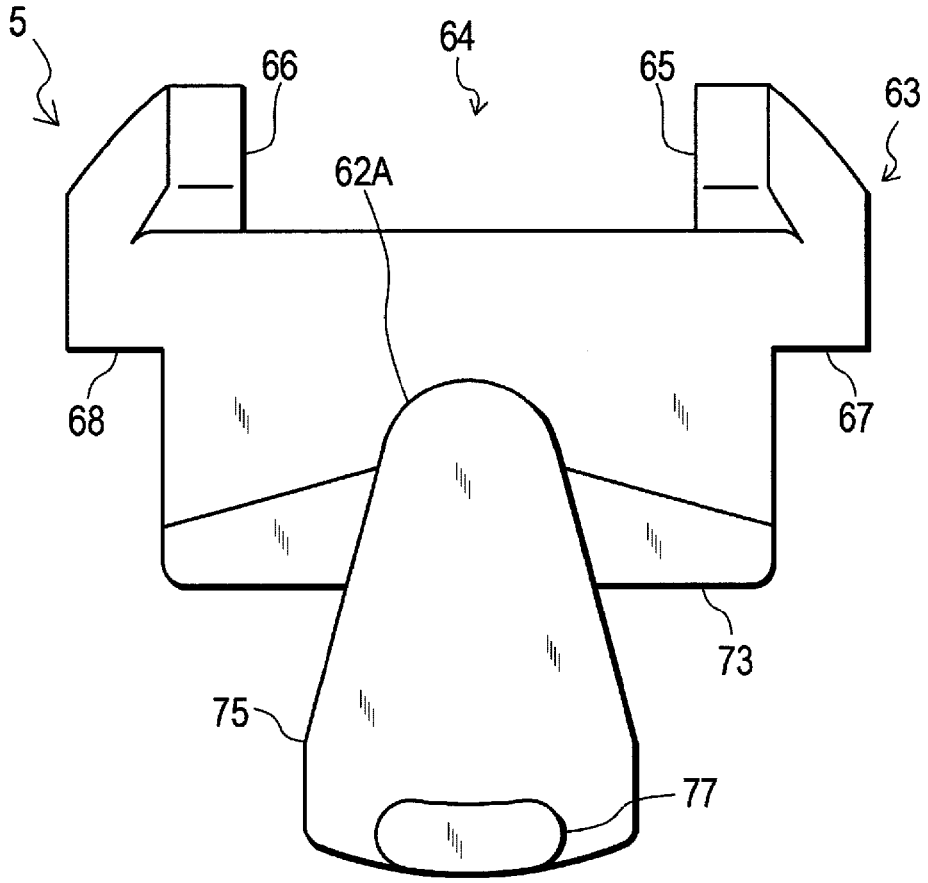
FIG. 15 is a left side view of the second swinging member of the multi-directional input device of FIG. 5.
Figure 16:
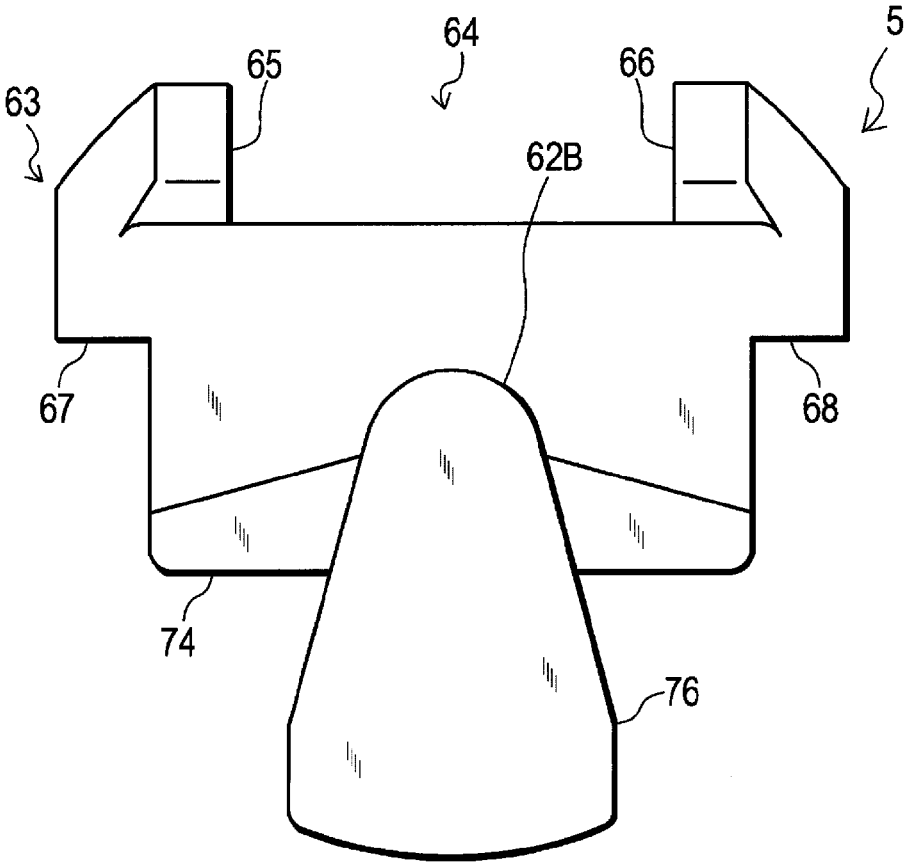
FIG. 16 is a right side view of the second swinging member of the multi-directional input device of FIG. 5.
Figure 17:
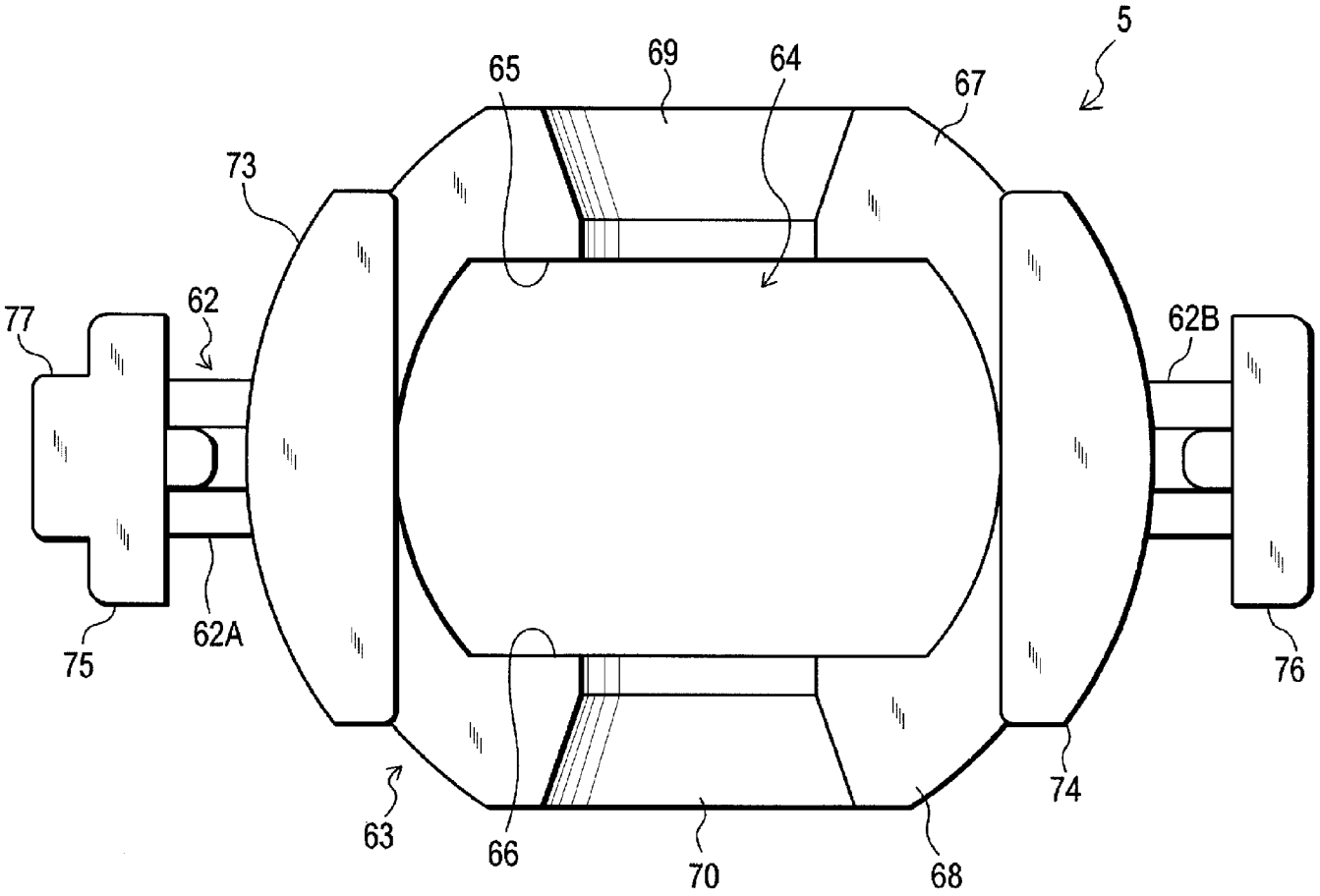
FIG. 17 is a bottom plan view of the second swinging member of the multi-directional input device of FIG. 5.

FIG. 14 is a front view of the second swinging member 5, FIG. 15 is a left side view of the second swinging member 5, FIG. 16 is a right side view of the second swinging member 5, and FIG. 17 is a bottom plan view of the second swinging member 5.

As shown also in FIGS. 14 to 17, the second swinging member 5 has a second swing shaft 62 which extends in a direction perpendicular to the first swing shaft 41, and is held in the case 2 so as to swing about the second swing shaft 62 in accordance with the tilting operation of the operating member 3.

The second swinging member 5 has an engaging portion 63 which is integrally swingably coupled with the second swing shaft 62.

The engaging portion 63 includes a long hole 64 which extends in the axial direction of the second swing shaft 62, and is disposed so as to cover the fulcrum portion 32 of the operating member 3 from the upper side while allowing the shaft portion to pass through the long hole 64 so that the shaft portion is movable in the longitudinal direction, in such a manner that the engaging portion and the fitting portion 42 of the first swinging member 4 cooperate to vertically sandwich the fulcrum portion 32. The engaging portion is configured so as to be engageable with the shaft portion 31 of the operating member 3 in the axial direction of the first swing shaft 41.

In the embodiment, the second swinging member 5 is made of an insulating resin, and combined from the upper side with the first swinging member 4. The second swing shaft 62 is placed so that the axial direction is set in the lateral direction, and configured by a left shaft portion 62A and a right shaft portion 62B. Each of the left and right shaft portions 62A, 62B is formed into a round rod-like shape.

The left and right shaft portions 62A, 62B are coaxially placed so as to sandwich the engaging portion 63 in the lateral direction while setting the respective axial directions coincident with a substantially horizontal direction, and disposed to be swingable with respect to the upper case 12. The left and right shaft portions 62A, 62B (the second swing shaft 62) are integrally swingably coupled with the engaging portion 63 in respective axial end parts.

The left and right shaft portions 62A, 62B are placed in a substantially same plane as the first swing shaft 41 of the first swinging member 4, i.e., the front and rear shaft portions 41A, 41B, and disposed so as to be swingable independently from the front and rear shaft portions 41A, 41B.

The engaging portion 63 can accommodate a part of the shaft portion 31, the left and right engaging portions 51, 52 of the first swinging member 4, and the like, and is configured by a hollow semispherical member which is upwardly convex. The long hole 64 extends in an upper part of the engaging portion 63 and in the lateral direction so as to pass in the vicinity of the top part, and is disposed so as to be upwardly and downwardly opened.

In order to allow the shaft portion 31 and the left and right engaging portions 51, 52 of the first swinging member 4 which laterally sandwich the shaft portion, to pass through the long hole 64, and also to laterally move, the longitudinal width (lateral width) of the long hole 64 is set larger than the total of the lateral widths of the shaft portion and the engaging portions. By contrast, the short-side direction width (anteroposterior width) of the long hole 64 is set approximately equal to the anteroposterior width of the shaft portion 31.

In the engaging portion 63, therefore, the front and rear surfaces 65, 66 of the inner surface of the long hole function as engaging surfaces which, when the shaft portion 31 is passed through the long hole 64, are forwardly and backwardly engaged with the shaft portion 31, and also as guide surfaces which guide the shaft portion 31 that is moved in the longitudinal direction (lateral direction of the long hole 64.

The engaging portion 63 further has a front cut away portion 67 and a rear cut away portion 68. In order to prevent the engaging portion 63 from interfering with the first swinging member 4 (the front shaft portion 41A and the front supporting portion 56) when the first swinging member 4 and the second swinging member 5 are combined with each other, the front cut away portion 67 is formed into a concave shape which is downwardly opened, by cutting away a lower side of a front portion of the engaging portion 63.

In order to prevent the engaging portion 63 from interfering with the first swinging member 4 (the rear shaft portion 41B and the rear supporting portion 57) when the first swinging member 4 and the second swinging member 5 are combined with each other, the rear cut away portion 68 is formed into a concave shape which is downwardly opened, by cutting away a lower side of a rear portion of the engaging portion 63. Therefore, the second swing shaft 62 can be placed in a substantially same plane as the first swing shaft 41.

In the embodiment, when the engaging portion 63 is combined with the operating member 3, moreover, the lower surface of the front cut away portion 67 bumps, from the upper side, a front upper part of the fulcrum portion 32 of the operating member 3 which is located below the lower surface, and the lower surface of the rear cut away portion 68 bumps, from the upper side, a rear upper part of the fulcrum portion 32 which is located below the lower surface, whereby it is enabled to press the fulcrum portion 32 from the upper side.

In the embodiment, the engaging portion 63 has a front concave part 69 and a rear concave part 70. The front concave part 69 is formed in the lower surface of the front cut away portion 67 so as to be engageable with a front convex part 71 which is disposed on the front swelling surface 36 of the fulcrum portion 32. The rear concave part 70 is formed in the lower surface of the rear cut away portion 68 so as to be engageable with a rear convex part 72 which is disposed on the rear swelling surface 37 of the fulcrum portion 32.

When the engaging portion 63 is to cover, from the upper side, the fulcrum portion 32 fitted to the fitting portion 42, therefore, the front concave part 69 is engaged by the front convex part 71 of the fulcrum portion 32, and the rear concave part 70 is engaged by the rear convex part 72 of the fulcrum portion 32. Consequently, the fulcrum portion 32 is engagingly held by the engaging portion 63 to restrict the upward movement of the operating member 3, whereby the operating member 3 can be prevented from slipping off.

Each of the front and rear concave parts 69, 70 has an inner surface configured by an arcuate surface which is upwardly concave so as to correspond to the front convex part 71 or the rear convex part 72, and, after being engaged by the front convex part 71 or the rear convex part 72, can guide the fulcrum portion 32 which is swung in accordance with a lateral tilting operation of the operating member 3.

The second swinging member 5 further has a left supporting portion 73 and a right supporting portion 74. Each of the left and right supporting portions 73, 74 has a lower surface configured by a substantially flat surface (substantially horizontal surface). The left and right supporting portions are placed on the left and right sides of the engaging portion 63, respectively so that the lower surfaces are located at a substantially same level, and at a substantially same level as or lower than the left and right shaft portions 62A, 62B.

Specifically, the left supporting portion 73 is disposed so as to be leftwardly projected from a lower part of the engaging portion 63 along the left shaft portion 62A, and placed on both the front and rear sides of the left shaft portion 62A. The right supporting portion 74 is disposed so as to be rightwardly projected from a lower part of the engaging portion 63 along the right shaft portion 62B, and placed on both the front and rear sides of the right shaft portion 62B.

The left and right supporting portions 73, 74 are disposed so that, when the first swinging member 4 and the second swinging member 5 are combined with each other, their lower surfaces are located at an approximately same level as the lower surfaces of the front and rear supporting portions 56, 57 of the first swinging member 4.

The second swinging member 5 further has a left second elongated portion 75 and a right second elongated portion 76. The left second elongated portion 75 is downwardly elongated from the other axial end part (left end part) of the left shaft portion 62A. The left second elongated portion 75 is formed into a sector shape as viewed from the lateral side, and integrally swingably fixed to the left shaft portion 62A so that a lower end part corresponding to the arcuate part of the shape is not contacted with the circuit board 10.

The lower end part of the left second elongated portion 75 includes a second operation projection 77. The second operation projection 77 functions to convert the swinging movement of the left shaft portion 62A (the second swinging member 5) to a linear movement, and, when the left second elongated portion 75 is swung integrally with the left shaft portion 62A, is forwardly and backwardly displaceable. The second operation projection 77 is formed into an arcuate shape which extends along the arcuate part of the left second elongated portion 75.

In the multi-directional input device 1, in the case where the operating member 3, the first swinging member 4, and the second swinging member 5 are combined with one another in the case 2, when the operating member 3 is tilted in an arbitrary direction with using the fulcrum portion 32 as a fulcrum, therefore, the first swinging member 4 and the second swinging member 5 are swingable independently from each other in accordance with the tilting operation of the operating member 3.

When the operating member 3 is tilted in the axial direction (leftwardly or rightwardly) of the second swing shaft 62, for example, the left or right engaging surface 38 or 39 of the fulcrum portion 32 of the operating member 3, and the left or right engaging surface 48 or 49 of the fitting portion 42 of the first swinging member 4 are engageable with each other, and furthermore the left engaging surface 34 or 35 of the shaft portion 31, and the left or right engaging surface 53 of the left engaging portion 51 or the right engaging surface 54 of the right engaging portion 52 are engageable with each other.

When the operating member 3 is tilted from the initial reference position (neutral position), therefore, the first swinging member 4 can be swung about the first swing shaft 41 so as to be moved in conjunction with the operating member 3. In this case, the operating member 3 causes the shaft portion 31 to move along the long hole 64 in the longitudinal direction (leftwardly or rightwardly), and therefore the second swinging member 5 is not swung.

When the operating member 3 is tilted in the axial direction (forwardly or rearwardly) of the first swing shaft 41, the shaft portion 31 of the operating member 3 which is passed through the long hole 64, and the front or rear surface 65 or 66 of the engaging portion 63 of the second swinging member 5 are engageable with each other.

When the operating member 3 is tilted from the initial reference position, therefore, the second swinging member 5 is swingable about the second swing shaft 62 so as to be moved in conjunction with the operating member 3. In this case, the operating member 3 causes the fulcrum portion 32 to be swung relative to the fitting portion 42 along the front and rear guide surfaces 45, 46 by using the front and rear swelling surfaces 36, 37, and therefore the first swinging member 4 is not swung.

In the multi-directional input device 1, the first detecting device 6 is configured so as to detect the swinging operation of the first swinging member 4. In the embodiment, in order to sense the lateral tilt amount of the operating member 3, the first detecting device 6 detects the swinging operation of the first swinging member 4, and is configured by a first slider 81 of the straight-ahead type, and a first variable resistor 82.

The first slider 81 is configured so as to straightly move on the circuit board 10 in a direction (lateral direction) perpendicular to the first swing shaft 41, in accordance with the swinging operation of the first swinging member 4 due to a lateral tilting operation of the operating member 3. The first slider 81 is disposed on the circuit board 10 so as to be laterally slidable, and placed on the rear side of the first swinging member 4.

In the first slider 81, a first engaging concave portion 83 which is downwardly opened is disposed. In order to enable the first slider 81 to laterally engage with the first operation projection 59, the first operation projection 59 is accommodated in the first engaging concave portion 83 so as to be vertically movable. The first slider is laterally slid by lateral displacement of the first operation projection 59.

The first variable resistor 82 is of the slide type. The first variable resistor 82 is configured by a first resistance circuit formed on the circuit board 10, and a contactor which slides on and contacts with the first resistance circuit. In order to slide on the first resistance circuit in accordance with the sliding movement of the first slider 81, the contactor is attached to an opposing surface (lower surface) of the first slider 81 which is opposed to the circuit board 10.

The second detecting device 7 is configured so as to detect the swinging operation of the second swinging member 5. In the embodiment, in order to sense the anteroposterior tilt amount of the operating member 3, the second detecting device 7 detects the swinging operation of the second swinging member 5, and is configured by a second slider 85 of the straight-ahead type, and a second variable resistor 86.

The second slider 85 is configured so as to straightly move on the circuit board 10 in a direction (anteroposterior direction) perpendicular to the second swing shaft 62, in accordance with the swinging operation of the second swinging member 5 due to an anteroposterior tilting operation of the operating member 3. The second slider 85 is disposed on the circuit board 10 so as to be forwardly and backwardly slidable, and placed on the left side of the second swinging member 5.

In the second slider 85, a second engaging concave portion 87 which is downwardly opened is disposed. In order to enable the second slider 85 to forwardly and backwardly engage with the second operation projection 77, the second operation projection 77 is accommodated in the second engaging concave portion 87 so as to be vertically movable. The second slider is forwardly and backwardly slid by anteroposterior displacement of the second operation projection 77.

The second variable resistor 86 is of the slide type. The second variable resistor 86 is configured by a second resistance circuit formed on the circuit board 10, and a contactor which slides on and contacts with the second resistance circuit. In order to slide on the second resistance circuit in accordance with the sliding operation of the second slider 85, the contactor is attached to an opposing surface (lower surface) of the second slider 85 which is opposed to the circuit board 10.

Although, in the embodiment, each of the first and second detecting devices in the invention is configured as the first or second detecting device 6 or 7 which can indirectly detect the swinging operation of the first or second swinging member 4 or 5, the detecting devices are not particularly limited. For example, the detecting devices may be configured by sensors (optical sensors, magnetic sensors, or the like) which can directly detect the swinging operation.

The returning member 8 is used for returning the operating member 3 to the origin. In the embodiment, the returning member 8 elastically holds the first swinging member 4 and the second swinging member 5 to the initial reference position (neutral position), whereby the swinging members are enabled to return to the origin after the tilting and pressing operations of the operating member 3. The returning member has a ring 88 and a spring 89.

The ring 88 includes an upper surface configured by a substantially flat surface which can be in surface contact with the lower surfaces of the front and rear supporting portions 56, 57 of the first swinging member 4, and those of the left and right supporting portions 73, 74 of the second swinging member 5. In order to establish the surface contacts, the ring 88 is fitted from the lower side onto the fitting portion 42 of the first swinging member 4.

The spring 89 is interposed in a compressed state between the ring 88 and the bottom plate portion 14 of the lower case 11 (or a metal cover attached to the bottom plate portion 14), and upwardly urges the first swinging member 4 and the second swinging member 5 through the ring 88. In the embodiment, therefore, a press-down operation can be performed on the operating member 3.

Although, in the embodiment, the returning member in the invention is configured as the returning member 8 having the spring 89, the returning member is not particularly limited. For example, the returning member may have springs for urging respectively the sliders 81, 85 in order to cause the first swinging member 4 and the second swinging member 5 to return to the origin.

According to the above-described configuration, in the multi-directional input device 1, when the operating member 3 is tilted, as described above, the first swinging member 4 and the second swinging member 5 can be swung independently from each other in accordance with the tilting operation of the operating member. Therefore, the swinging operations of the first and second swinging members 4, 5 can be detected by the first and second detecting devices 6, 7, respectively, and the tilt amount of the operating member 3 can be sensed.

Even in the case where the operating member 3 is being returned to the origin, the fulcrum portion 32 of the operating member 3 can be engaged in the axial direction of the second swing shaft 62 with the left or right engaging surface 48 or 49 of the fitting portion 42 in the state where the fulcrum portion 32 is fitted into the fitting portion 42 of the first swinging member 4. Therefore, rotation of the operating member 3 about the shaft portion 31 can be restricted.

Moreover, the structure is employed in which the fulcrum portion 32 of the operating member 3 is fitted into the fitting portion 42 in order to cause the fulcrum portion 32 to engage with the left or right engaging surface 48 or 49 of the fitting portion 42 of the first swinging member 4. Therefore, the rigidity of the first swinging member 4 can be improved. As a result, the product strength of the multi-directional input device 1 can be enhanced, and, for example, torsional rotation of the operating member 3 can be surely prevented from occurring.

In the embodiment, the front and rear concave parts 69, 70 of the second swinging member 5, and the front and rear convex parts 71, 72 of the operating member 3 are engaged by each other, and therefore the upward movement of the fulcrum portion 32 is restricted by the second swinging member 5 (the engaging portion 63). Consequently, the operating member 3 can be surely prevented from slipping off from the second swinging member 5 (the case 2).

In the embodiment, as shown in FIG. 4, the multidirectional input device 1 further includes a depression switch 91. The depression switch 91 has: a pusher 92 which is accommodated in the case 2 so as to be vertically movable in accordance with the swinging operation of the first swinging member 4; and a snap type contact member 93 which upwardly urges the pusher 92. The depression switch is configured so as to detect depression of the operating member 3.

The pusher 92 has a concave portion 95 which is upwardly opened, and is configured so that the concave portion 95 can butt against the other axial end part of the front shaft portion 41A which is inserted into the concave portion from the rear side. When the operating member 3 is not depressed and the first swinging member 4 is at the initial reference position, the pusher 92 is maintained in a state where the pusher does not butt against the front shaft portion 41A. The lower end surface of the pusher 92 is formed into a dome-like shape which is downwardly convex.

The front shaft portion 41A includes, in a lower portion which can butt against the pusher 92, a butting surface 96 configured by a curved surface which is curved more gently than the upper portion so that the surface is downwardly convex as viewed from the front side. When the first swinging member 4 is downwardly moved in accordance with depression of the operating member 3, the front shaft portion is downwardly moved together with the first elongated portion 58 so that the butting surface 96 butts against the concave portion 95 (bottom surface of the portion), and further downwardly moved while maintaining the state.

The contact member 93 is configured by a snap plate which is formed into a dome-like shape that is upwardly convex, and disposed on the circuit board 10 which is attached to the upper surface of the bottom plate portion 14 of the lower case 11. The contact member 93 is contacted with the lower end surface of the pusher 92 to which the member is vertically opposed, to upwardly urge the pusher 92.

When the operating member 3 is depressed against the urging force exerted by the returning member 8, therefore, the first swinging member 4, i.e., the first swing shaft 41 (the front shaft portion 41A), and the first elongated portion 58 are pressed in accordance with the depressing operation to be downwardly moved. As a result of the downward movement, the butting surface 96 of the front shaft portion 41A first bumps the pusher 92, and the lower end part of the first elongated portion 58 bumps the bottom plate portion 14 of the lower case 11.

When the depressing operation on the operating member 3 is further advanced in this state, the first swinging member 4 is slightly swung with using the vicinity of the lower end part of the first elongated portion 58 as a fulcrum, so as to cause the front shaft portion 41A which is in the state where the portion butts against the pusher 92, to be downwardly moved. Therefore, the front shaft portion 41A downwardly pushes the pusher 92 against the urging force of the contact member 93, whereby the pusher 92 is downwardly moved.

As a result, the contact member 93 can be pushed by the pusher 92, and therefore a switch circuit formed on the surface of the circuit board 10 can be switched from the open state to the closed state. In the embodiment, as described above, the first swinging member 4 is provided with sufficient rigidity. In this case, therefore, good clicking sensation can be produced in the depressing operation on the operating member 3.

In the embodiment, during the dressing operation on the operating member 3, also the first operation projection 59 of the first swinging member 4 can be downwardly moved to be relatively downward moved with respect to the first slider 81 of the first detecting device 6, and therefore no load is applied to the first slider 81. Consequently, the durability can be improved.

In the embodiment, as shown in FIG. 2, the first operation projection 59 is placed in a bottom portion of the case 2, and the first swing shaft 41 is placed in a ceiling portion of the case 2. Then, the first swinging member 4 is swung about the first swing shaft 41, thereby enabling the first operation projection 59 to be laterally displaceable.

In the first detecting device 6, therefore, the turning radius of the first operation projection 59 can be made as large as possible, and the movable distance of the first slider 81 in the lateral (horizontal) direction can be prolonged. Consequently, the resolution of the first detecting device 6 can be improved.

The second operation projection 77 of the second swinging member 5 is placed in the bottom portion of the case 2, and the second swing shaft 62 is placed in the ceiling portion of the case 2. Then, the second swinging member 5 is swung about the second swing shaft 62, thereby enabling the second operation projection 77 to be forwardly and backwardly displaceable.

In the second detecting device 7, therefore, the turning radius of the second operation projection 77 can be made as large as possible, and the movable distance of the second slider 85 in the anteroposterior (horizontal) direction can be prolonged. Consequently, the resolution of the second detecting device 7 can be improved.

Next, a second embodiment of the invention will be described with reference to the drawings.

Figure 18:
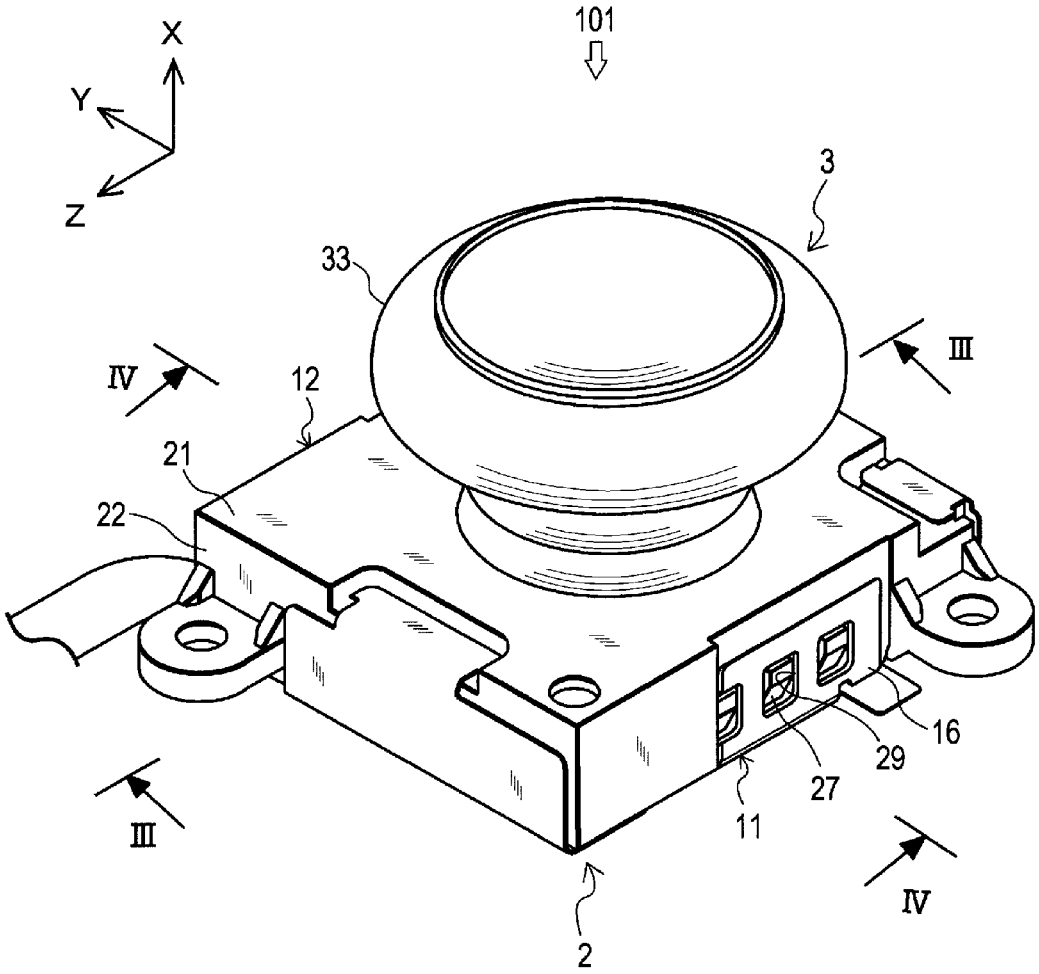
FIG. 18 is a front perspective view of a multidirectional input device of a second embodiment of the invention.
Figure 19:
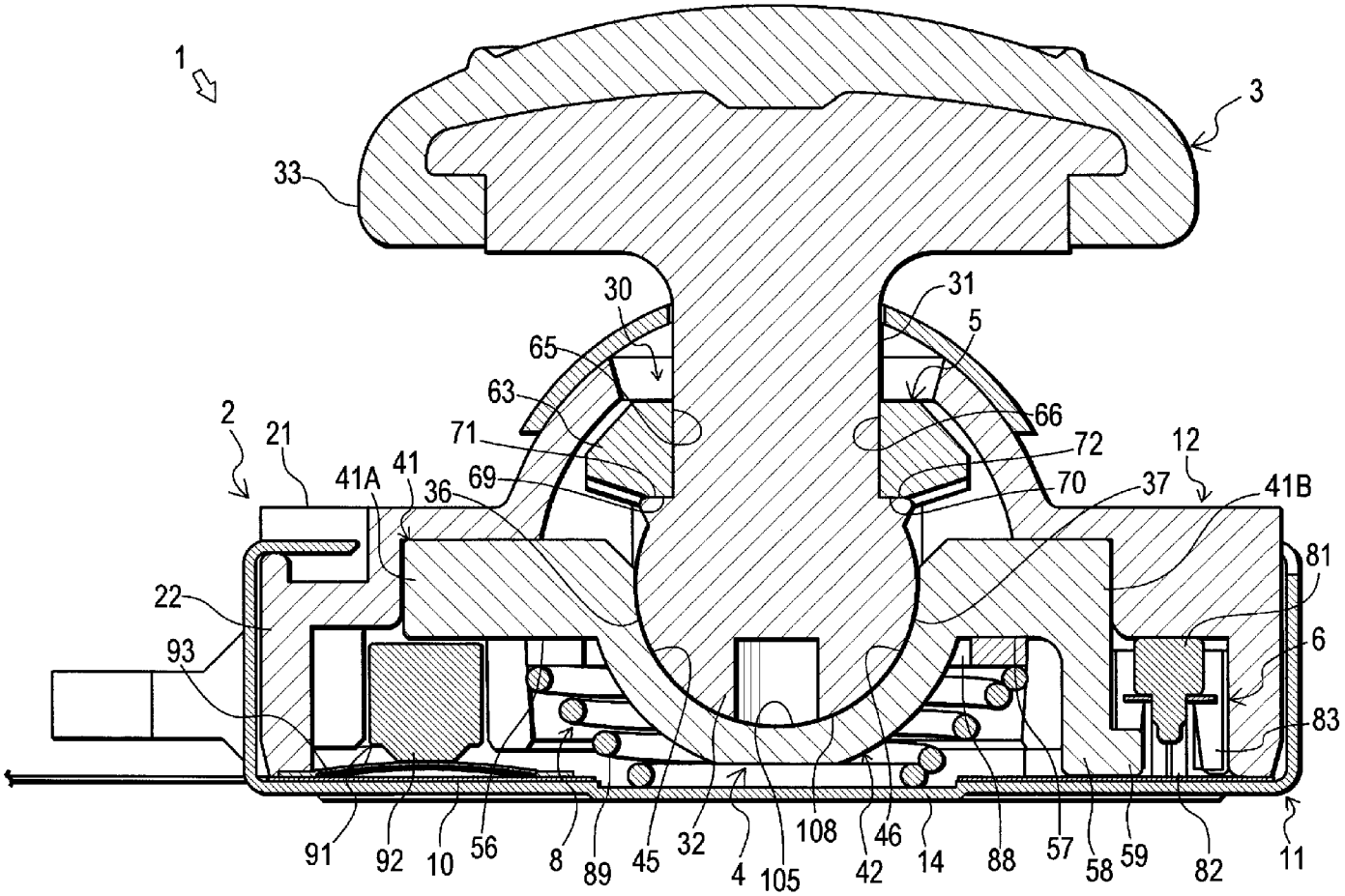
FIG. 19 is a sectional view as seen in the direction of arrows III-III in FIG. 18.
Figure 20:
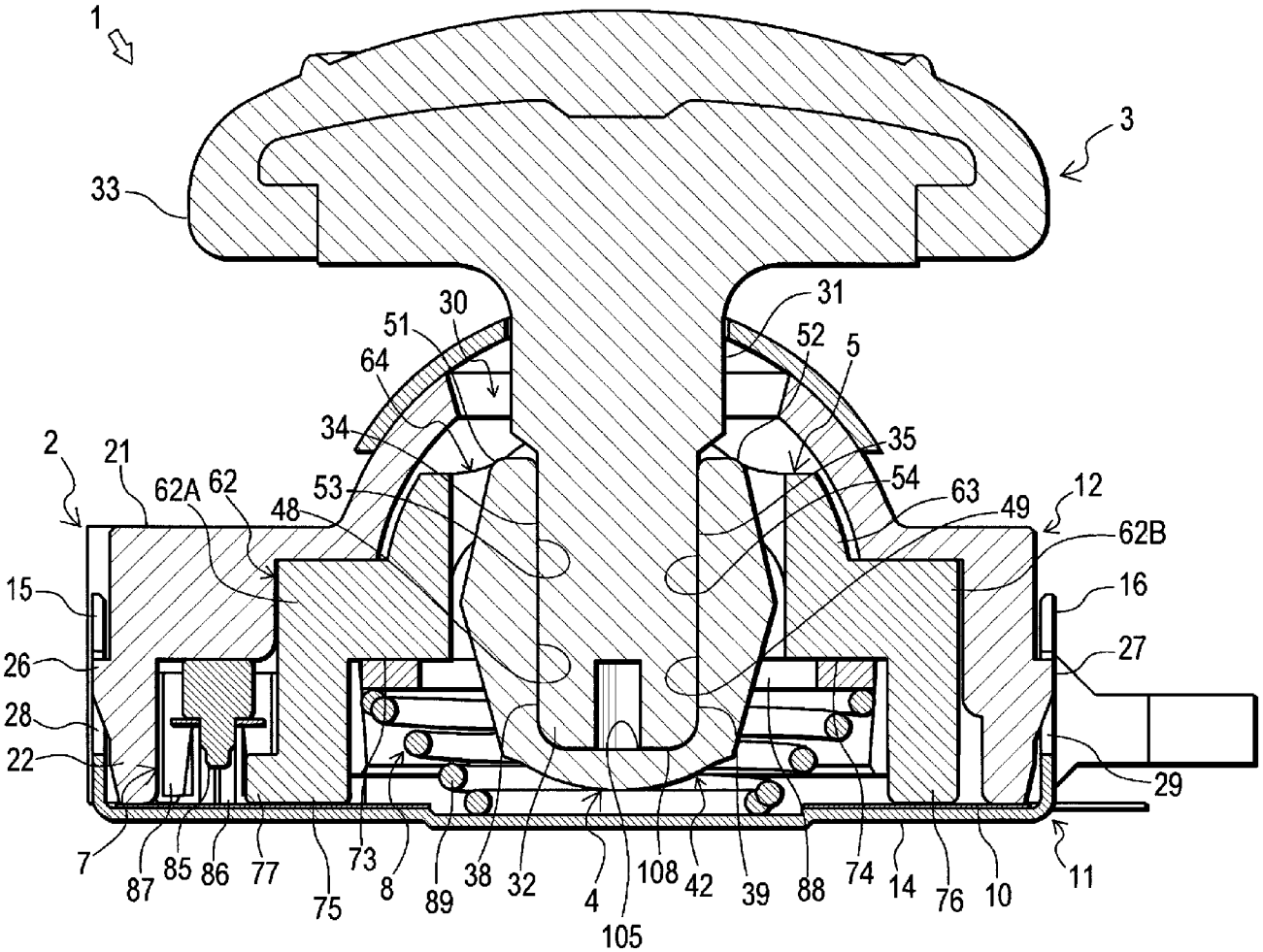
FIG. 20 is a sectional view as seen in the direction of arrows IV-IV in FIG. 18.

FIG. 18 is a front perspective view of a multidirectional input device 101 of the second embodiment of the invention, FIG. 19 is a sectional view as seen in the direction of arrows III-III in FIG. 18, and FIG. 20 is a sectional view as seen in the direction of arrows IV-IV in FIG. 18.

As shown in FIGS. 18 to 20, the multi-directional input device 101 is mainly different from the multidirectional input device 1 of the first embodiment in the fitting structure in which the fulcrum portion 32 of the operating member 3 is fitted into the fitting portion 42 of the first swinging member 4. The components which are substantially identical with those of the first embodiment are denoted by the same reference numerals, and their description is omitted.

Figure 21:
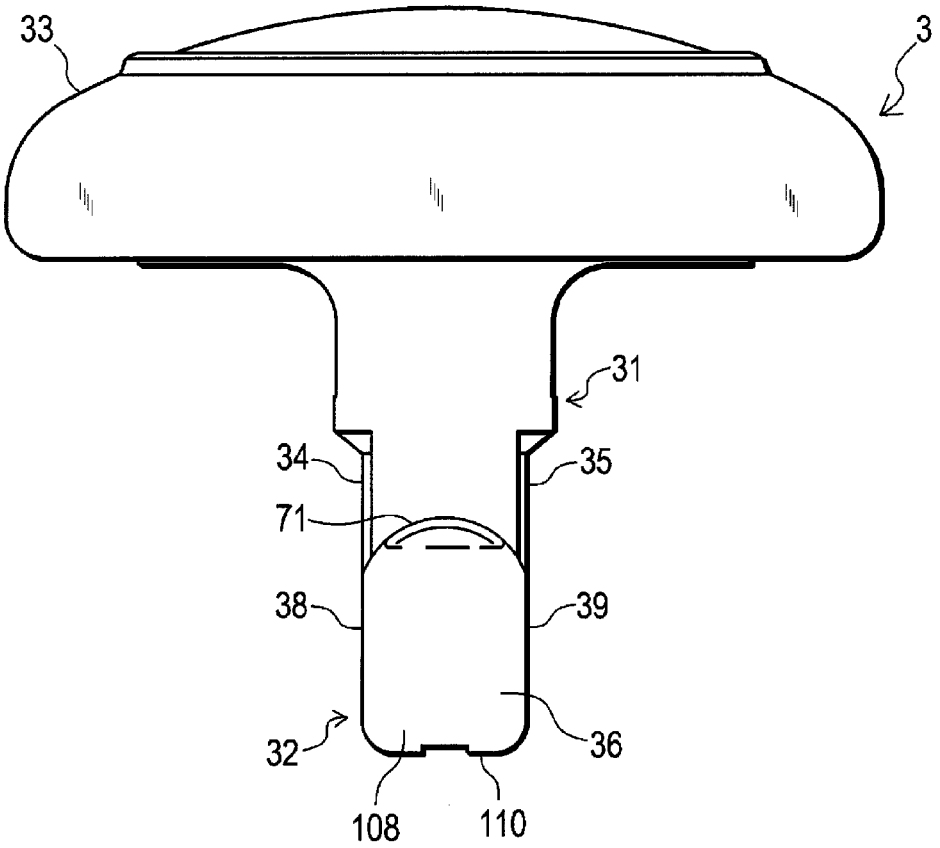
FIG. 21 is a front view of the operating member of the multi-directional input device of FIG. 18.
Figure 22:
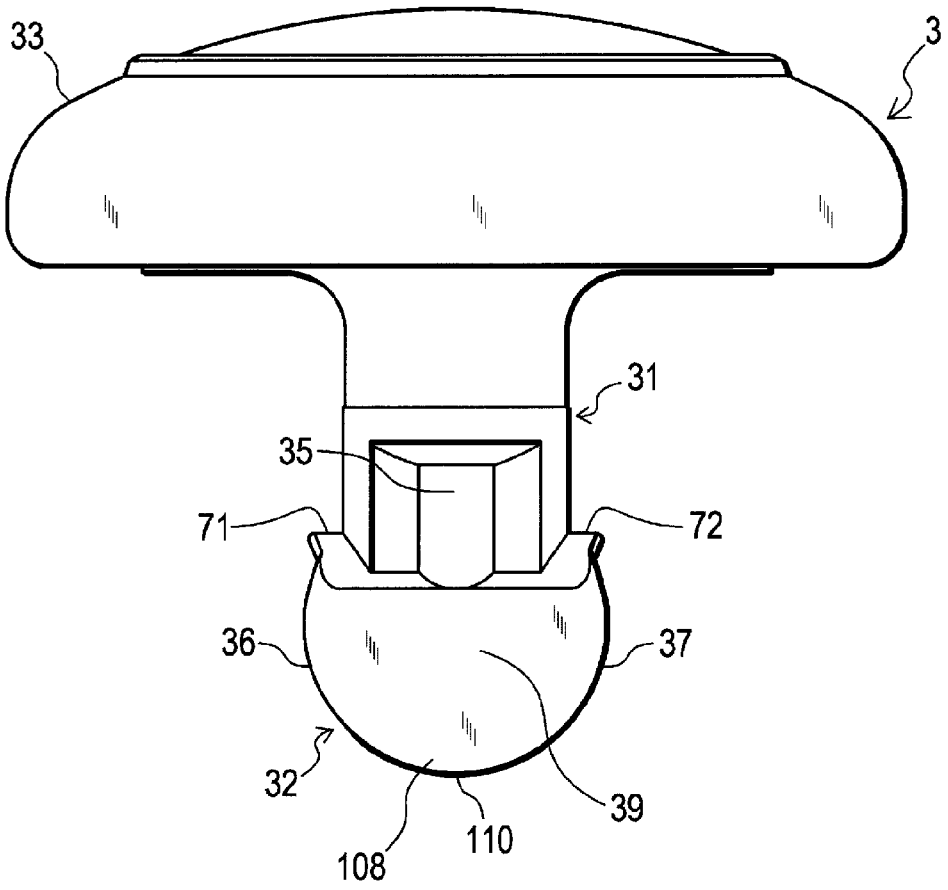
FIG. 22 is a right side view of the operating member of the multi-directional input device of FIG. 18.
Figure 23:
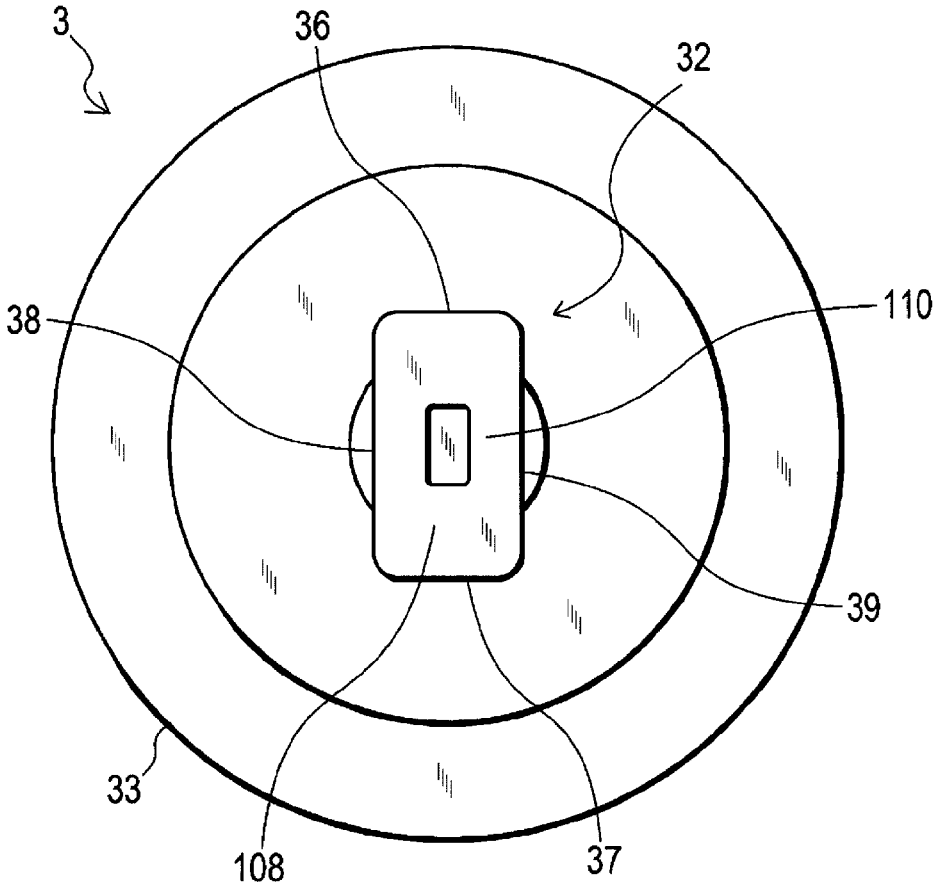
FIG. 23 is a bottom plan view of the operating member of the multi-directional input device of FIG. 18.
Figure 24:
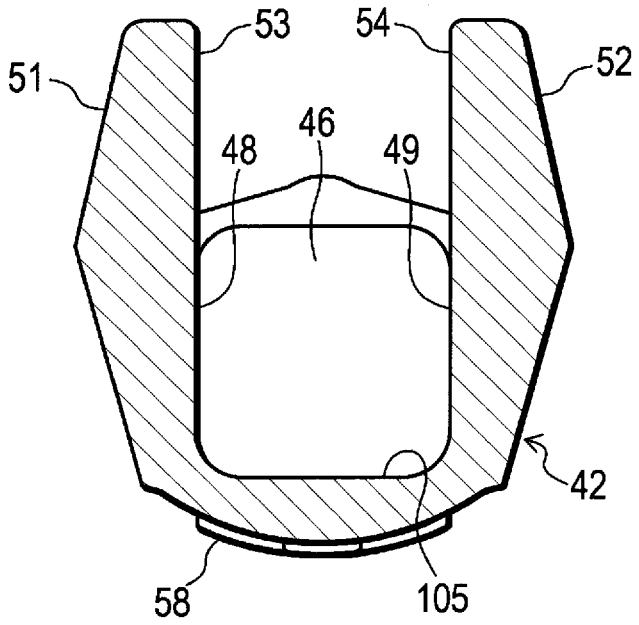
FIG. 24 is a front sectional view of the first swinging member of the multi-directional input device of FIG. 18.
Figure 25:
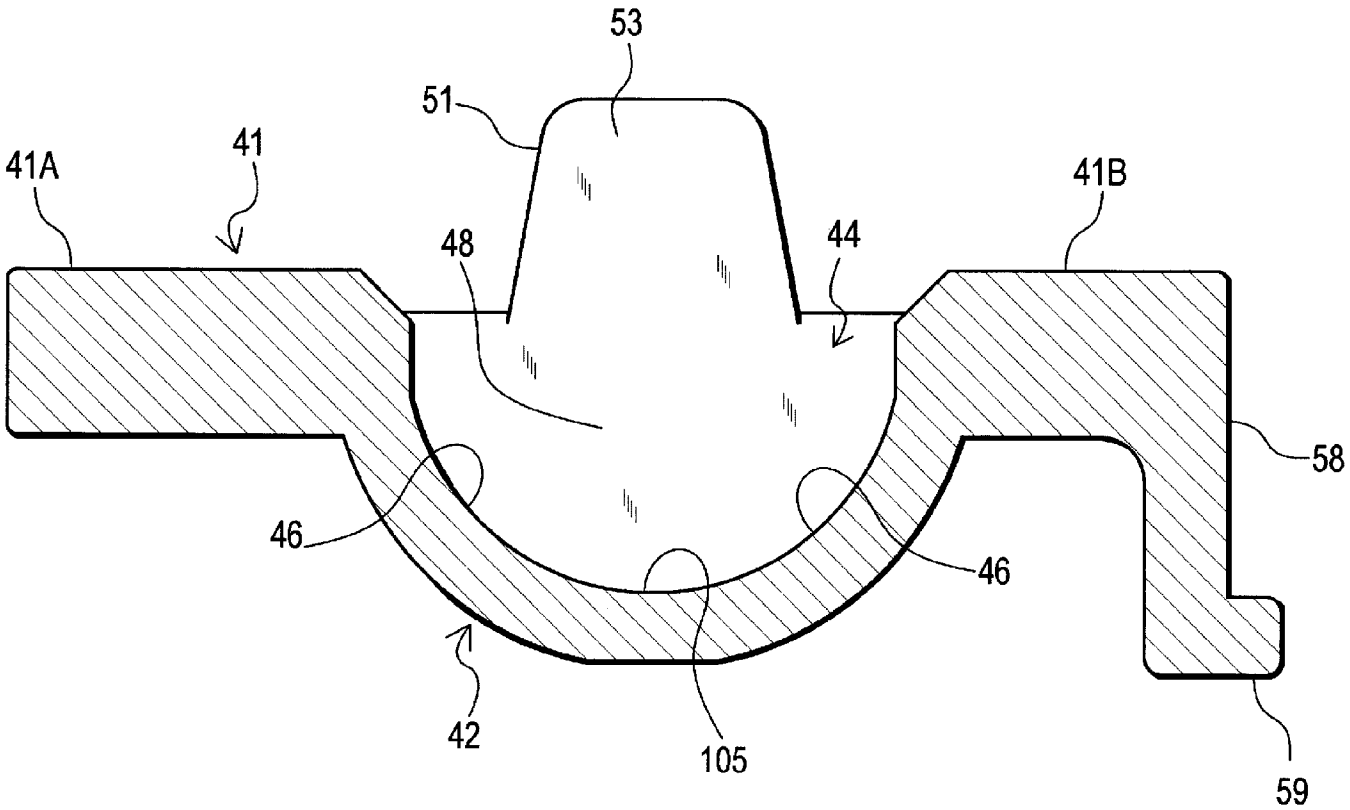
FIG. 25 is a right side sectional view of the swinging member of the multi-directional input device of FIG. 18.

FIG. 21 is a front view of the operating member 3 of the multi-directional input device 101, FIG. 22 is a right side view of the operating member 3, FIG. 23 is a bottom plan view of the operating member 3, FIG. 24 is a front sectional view of the first swinging member 4 of the multi-directional input device 101, and FIG. 25 is a right side sectional view of the first swinging member 4.

In the multi-directional input device 101, as shown also in FIGS. 21 to 25, the first swinging member 4 includes, inside the fitting portion 42, the front and rear guide surfaces 45, 46 and the left and right engaging surfaces 48, 49, and further includes a supporting surface 105 which is formed so as to be contactable with the fulcrum portion 32 of the operating member 3 so as to support the fulcrum portion 32 from the lower side.

The fulcrum portion 32 of the operating member 3 is fitted into the fitting portion 42 of the first swinging member 4 so as be in contact with the front and rear guide surfaces 45, 46, left and right engaging surfaces 48, 49, and supporting surface 105 which are inside the fitting portion 42. In the embodiment, namely, a lower end part 108 of the fulcrum portion 32 can be supported by a bottom part of the fitting portion 42 of the first swinging member 4.

Specifically, as shown in FIG. 25, the fitting portion 42 of the first swinging member 4 is configured by a hollow semispherical member which is downwardly convex, and includes the fitting hole 44 which is upwardly opened. The front and rear guide surfaces 45, 46, the left and right engaging surfaces 48, 49, and the supporting surface 105 are disposed on the inner surface of the fitting hole 44 (inside the fitting portion 42).

The supporting surface 105 is placed in a bottom portion of the inner surface of the fitting hole 44. That is, the supporting surface 105 is placed in the vicinity of the lower apex of the inner surface of the fitting hole 44 that is formed so as to exhibit a semispherical shape which is downwardly concave as viewed from the lateral side, and disposed so as to be opposed to the lower end part 108 of the fulcrum portion 32 when the fulcrum portion 32 is fitted into the fitting hole 44.

In the operating member 3, the lower end part 108 of the fulcrum portion 32 includes a contacting surface 110 which, when the fulcrum portion 32 is fitted into the fitting portion 42, is contactable with the supporting surface 105 of the fitting portion 42. In the embodiment, the contacting surface 110 is formed by a lower swelling surface configured by an arcuate surface which is downwardly convex so as to correspond to the supporting surface 105.

According to the configuration, when the fulcrum portion 32 of the operating member 3 is fitted into the fitting portion 42 of the first swinging member 4, the fulcrum portion 32 can be caused to bump the front and rear guide surfaces 45, 46 and left and right engaging surfaces 48, 49 which are located laterally around the fulcrum portion, to be supported thereby, and further bump the supporting surface 105 which is located below the fulcrum portion 32, to be supported thereby.

When an impact is axially applied to the operating member 3 from the side (on the side of the head portion 33) opposite to the fulcrum portion 32 across the shaft portion 31 because, for example, an apparatus on which the multi-directional input device 101 is mounted falls, therefore, it is possible to effectively mitigate an impact which is transmitted from the operating member 3 to the fitting portion 42 of the first swinging member 4 through the fulcrum portion 32. Therefore, the impact resistance property of the first swinging member 4 can be improved.

In the embodiment, particularly, the fulcrum portion 32 of the operating member 3 is placed so that, in the case of fitting, the portion is in contact with the whole area of the inner side of the fitting portion 42. Specifically, the fulcrum portion 32 is placed so that the portion is fitted into the fitting portion 42 so as to fill the fitting hole 44, and in contact with substantially the whole of the inner surface of the fitting hole 44 (the region approximately extending from the bottom portion to the peripheral portion of the opening).

Therefore, the fulcrum portion 32 can have the configuration where the portion bumps approximately the whole of the inner side of the fitting portion 42 (the region including the front and rear guide surfaces 45, 46, the left and right engaging surfaces 48, 49, and the supporting surface 105), and an impact which is transmitted from the operating member 3 to the fitting portion 42 can be mitigated more effectively. Therefore, the impact resistance property of the first swinging member 4 can be improved.

DESCRIPTION OF REFERENCE NUMERALS

1 multi-directional input device
2 case
3 operating member
4 first swinging member
5 second swinging member
6 first detecting device
7 second detecting device
8 returning member
10 circuit board
31 shaft portion
32 fulcrum portion
41 first swing shaft
42 fitting portion
45 front guide surface
46 rear guide surface
48 left engaging surface
49 right engaging surface
62 second swing shaft
63 engaging portion
64 long hole
101 multi-directional input device
105 supporting surface

The invention claimed is:

1. A multi-directional input device including:

a case;

a tiltable operating member which is projected from an interior to an outside of the case;

a first swinging member which has a first swing shaft, and which is held in the case to be swingable about the first swing shaft in accordance with a tilting operation of the operating member;

a second swinging member which has a second swing shaft that extends in a direction perpendicular to an axial direction of the first swing shaft, and which is held in the case to be swingable about the second swing shaft in accordance with the tilting operation of the operating member;

first and second detecting devices which are configured to detect swinging operations of the first and second swinging members, respectively; and a returning member for returning the operating member to an origin, wherein the operating member has:

a shaft portion which is inserted into the case from an upper side; and a fulcrum portion which is coupled to an insertion end part of the shaft portion, the first swinging member has a concave fitting portion which is integrally swingably coupled with the first swing shaft, and which is formed to allow the fulcrum portion of the operating member to be fittable into the fitting portion from a lower side, and, inside the fitting portion, includes: engaging surfaces which are formed to be engageable with the fulcrum portion in an axial direction of the second swing shaft; and guide surfaces which allow the fulcrum portion to swing about the axial direction of the second swing shaft with respect to the first swinging member, and the second swinging member has:

an engaging portion which includes a long hole extending in the axial direction of the second swing shaft, and which covers the fulcrum portion of the operating member from an upper side while passing the shaft portion through the long hole in a manner that the shaft portion is movable in a longitudinal direction of the long hole, in such a manner that the engaging portion and the fitting portion cooperate to vertically sandwich the fulcrum portion, the engaging portion being integrally swingably coupled with the second swing shaft, and the engaging portion being engageable with the shaft portion in the axial direction of the first swing shaft.

2. The multi-directional input device according to claim 1, wherein one of the fulcrum portion of the operating member and the engaging portion of the second swinging member includes a concave part, another one of the fulcrum portion and the engaging portion includes a convex part, and, when the concave part and the convex part are engaged with each other, the engaging portion restricts an upward movement of the fulcrum portion.

3. The multi-directional input device according to claim 1, wherein the multi-directional input device further includes a depression switch which has a pusher that is accommodated in the case to be vertically movable, and a snap type contact member that upwardly urges the pusher, the depression switch being able to detect depression of the operating member, the operating member is able to be depressed to downwardly move the first swinging member, in the depression switch, the pusher is downwardly moved by the first swinging member which is downwardly moved by depression of the operating member, against an urging force of the contact member, and the contact member is pushed by the pusher.

4. The multi-directional input device according to claim 1, wherein each of the first and second detecting devices is configured by using:

a slider of a straight-ahead type which straightly moves on a circuit board in the case, in accordance with swinging of the first swinging member or the second swinging member due to tilting of the operating member; and a sliding variable resistor configured by a resistance circuit formed on the circuit board, and a contactor which is attached to an opposing surface of the slider, the opposing surface being opposed to the circuit board, the contactor sliding on and contacting with the resistance circuit.

5. The multi-directional input device according to claim 4, wherein each of the first swinging member and the second swinging member has an operation projection which, in order to enable the slider to move, converts a swinging movement of the first swinging member or the second swinging member to a linear movement, the operation projections of the first swinging member and the second swinging member are disposed on a bottom portion of the case, and the first swing shaft and the second swing shaft are placed in a ceiling portion of the case.

6. The multi-directional input device according to claim 4, wherein the operating member is configured to be depressable to cause the first swinging member to be downwardly moved, the first swinging member has:

an operation projection which, in order to enable the slider to move, converts a swinging movement of the first swinging member to a linear movement, and the slider has:

a concave portion which vertically movably accommodates the operation projection so as to be engaged with the operation projection in a movement direction of the slider.

7. The multi-directional input device according to claim 1, wherein the first swinging member further includes a supporting surface which, in the fitting portion, is formed to be contactable with the fulcrum portion of the operating member so as to support the fulcrum portion from a lower side, and the fulcrum portion of the operating member is fitted into the fitting portion to contact with the engaging surfaces, the guide surfaces, and the supporting surface that are in an inner side of the fitting portion.

8. The multi-directional input device according to claim 7, wherein the fulcrum portion of the operating member is placed to, in a case of fitting into the fitting portion, be in contact with a whole area of the inner side of the fitting portion.

9. The multi-directional input device according to claim 2, wherein each of the first and second detecting devices is configured by using:

a slider of a straight-ahead type which straightly moves on a circuit board in the case, in accordance with swinging of the first swinging member or the second swinging member due to tilting of the operating member; and a sliding variable resistor configured by a resistance circuit formed on the circuit board, and a contactor which is attached to an opposing surface of the slider, the opposing surface being opposed to the circuit board, the contactor sliding on and contacting with the resistance circuit.

10. The multi-directional input device according to claim 3, wherein each of the first and second detecting devices is configured by using:

a slider of a straight-ahead type which straightly moves on a circuit board in the case, in accordance with swinging of the first swinging member or the second swinging member due to tilting of the operating member; and a sliding variable resistor configured by a resistance circuit formed on the circuit board, and a contactor which is attached to an opposing surface of the slider, the opposing surface being opposed to the circuit board, the contactor sliding on and contacting with the resistance circuit.

11. The multi-directional input device according to claim 2, wherein the first swinging member further includes a supporting surface which, in the fitting portion, is formed to be contactable with the fulcrum portion of the operating member so as to support the fulcrum portion from a lower side, and the fulcrum portion of the operating member is fitted into the fitting portion to contact with the engaging surfaces, guide surfaces, and supporting surface that are in an inner side of the fitting portion.

12. The multi-directional input device according to claim 3, wherein the first swinging member further includes a supporting surface which, in the fitting portion, is formed to be contactable with the fulcrum portion of the operating member so as to support the fulcrum portion from a lower side, and the fulcrum portion of the operating member is fitted into the fitting portion to contact with the engaging surfaces, guide surfaces, and supporting surface that are in an inner side of the fitting portion.

13. The multi-directional input device according to claim 4, wherein the first swinging member further includes a supporting surface which, in the fitting portion, is formed to be contactable with the fulcrum portion of the operating member so as to support the fulcrum portion from a lower side, and the fulcrum portion of the operating member is fitted into the fitting portion to contact with the engaging surfaces, guide surfaces, and supporting surface that are in an inner side of the fitting portion.

14. The multi-directional input device according to claim 5, wherein the first swinging member further includes a supporting surface which, in the fitting portion, is formed to be contactable with the fulcrum portion of the operating member so as to support the fulcrum portion from a lower side, and the fulcrum portion of the operating member is fitted into the fitting portion to contact with the engaging surfaces, guide surfaces, and supporting surface that are in an inner side of the fitting portion.

15. The multi-directional input device according to claim 6, wherein the first swinging member further includes a supporting surface which, in the fitting portion, is formed to be contactable with the fulcrum portion of the operating member so as to support the fulcrum portion from a lower side, and the fulcrum portion of the operating member is fitted into the fitting portion to contact with the engaging surfaces, guide surfaces, and supporting surface that are in an inner side of the fitting portion.

* * * * *